US006722091B1

(12) United States Patent
Leslie et al.

(10) Patent No.: US 6,722,091 B1
(45) Date of Patent: Apr. 20, 2004

(54) RESIDENTIAL HOMES HAVING TENSIONED CURVED WALL PANELS

(75) Inventors: Robert H. Leslie, Edina, MN (US); Robert J. Leslie, 7521 Vincent Ave., South, Richfield, MN (US) 55423

(73) Assignee: Robert J. Leslie, Richfield, MN (US)

( * ) Notice: Subject to any disclaimer, the term of this patent is extended or adjusted under 35 U.S.C. 154(b) by 0 days.

(21) Appl. No.: 09/465,713

(22) Filed: Dec. 17, 1999

Related U.S. Application Data

(60) Provisional application No. 60/112,878, filed on Dec. 18, 1998.

(51) Int. Cl.[7] ..... E04B 1/32

(52) U.S. Cl. ..... 52/246; 52/248; 52/249; 52/82; 428/106; 428/107

(58) Field of Search ..... 52/245, 246, 247, 52/248, 79.4, 82, 249, 80.1; 428/106–109

(56) References Cited

U.S. PATENT DOCUMENTS

| | | | | | |
|---|---|---|---|---|---|
| 953,827 | A | * | 4/1910 | Haas | 52/245 |
| 998,575 | A | * | 7/1911 | Hanson | 52/82 |
| 1,060,745 | A | * | 5/1913 | Crotsly | 52/82 |
| 1,116,244 | A | * | 11/1914 | Conner | 52/82 |
| 1,346,161 | A | * | 7/1920 | Basquin | 144/380 |
| 1,533,905 | A | * | 4/1925 | Stauffer et al. | 52/82 |
| 2,074,854 | A | * | 3/1937 | Owens | 156/211 |
| 2,343,764 | A | * | 3/1944 | Fuller | 52/246 |
| 2,463,834 | A | * | 3/1949 | Breton | 52/245 |
| 2,649,625 | A | * | 8/1953 | Johnson | 20/1 |
| 2,818,009 | A | * | 12/1957 | Steffen | 52/82 |
| 2,955,686 | A | * | 10/1960 | Blomeley et al. | 189/3 |
| 3,146,549 | A | * | 9/1964 | James | 52/245 |
| 3,277,620 | A | * | 10/1966 | Martin | 52/82 |
| 3,956,555 | A | * | 5/1976 | McKean | 156/296 |
| 4,255,477 | A | * | 3/1981 | Holman | 428/106 |
| 5,470,631 | A | * | 11/1995 | Lindquist et al. | 162/131 |
| 5,590,493 | A | * | 1/1997 | Wilson | 52/245 X |
| 6,000,193 | A | * | 12/1999 | Valero-Cuevas et al. | 52/749.13 |
| 6,136,408 | A | * | 10/2000 | Radcliffe et al. | 264/29.4 |

FOREIGN PATENT DOCUMENTS

| | | | |
|---|---|---|---|
| EP | 309606 | * | 5/1989 |

* cited by examiner

*Primary Examiner*—Winnie S. Yip
(74) *Attorney, Agent, or Firm*—Haugen Law Firm PLLP

(57) ABSTRACT

A tensioned structure such as a house is disclosed. The house includes at least one wall panel placed under tension by bending the wall panel from a flat form to a curved form. The tension provides rigidity and thus strength to the wall panel. In a preferred form, the house includes two tensioned wall panels with the concave faces of the wall panels confronting each other such that a generally circular residential house is formed. A counter to oppose the tension engages the wall panels. The counter may include a roof or rafter support network, a portion of the floor or floor support, the wall panels themselves where the end edges of the wall panels are engaged to each other, or stainless steel straps running about the wall panels. The wall panel may be include material such as oriented strand board, steel, cement, plastic, or organic material such as grass. Further disclosed are methods for constructing the house and for bending without breaking material such as oriented strand board where the material is bent from a flat form to a curved form to place the material under tension so as to provide rigidity and strength to the structure having the tensioned sheet of material.

20 Claims, 26 Drawing Sheets

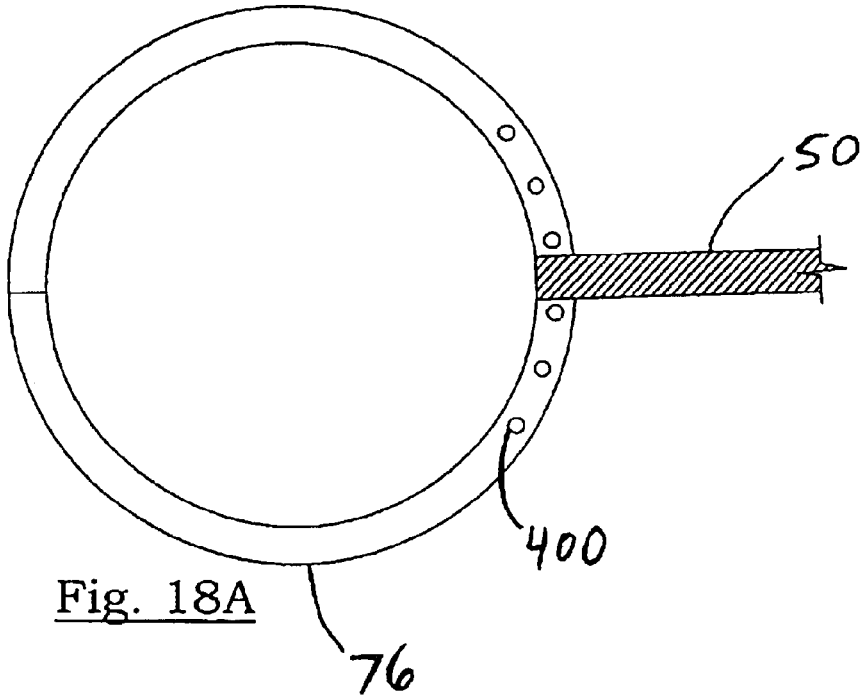
Fig. 18A
Fig. 18B
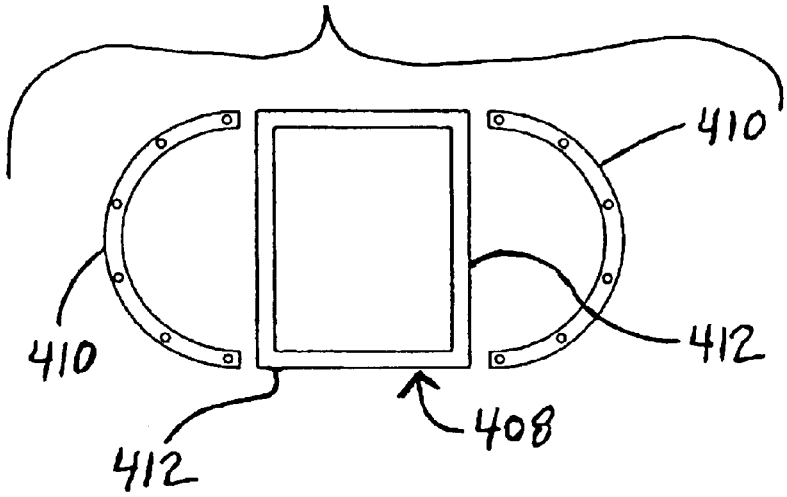

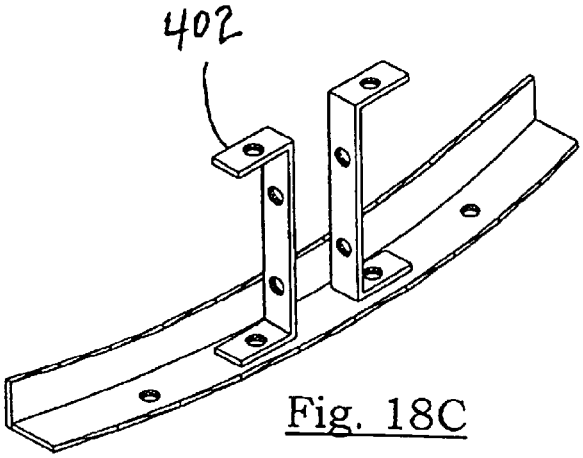
Fig. 18C
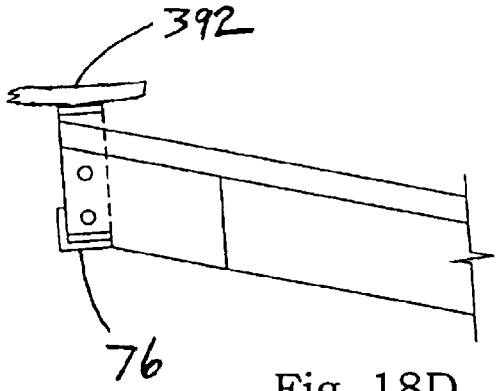
Fig. 18D
Fig. 18E
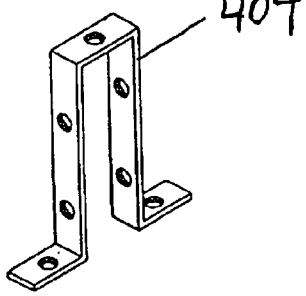

RESIDENTIAL HOMES HAVING TENSIONED CURVED WALL PANELS

This application claims the benefit of U.S. Provisional Application No. 60/112,878 filed Dec. 18, 1998.

BACKGROUND OF THE INVENTION

The present invention relates generally to tensioned structures, particularly to structures having sheets of materials that are placed under tension, and specifically to residential houses having curved wall panels placed under tension to provide rigidity to the wall panels and strength to the residential homes.

Niagara Falls daredevils have chosen the wooden barrel to take them over the Falls for several good reasons. It is strong. It is forgiving. It is round. The slats that make up the wooden barrel are bent without being broken and are then held in such a bent position under tension by circumferential straps. The slats thereby become relatively rigid, yet retain a certain degree of flexibility. When the barrel hits the bottom of the Falls, its strength and resiliency is one feature that may save the life of the thrill seeker. Another feature that may save his or her life is the shape of the barrel. The impact of the falling, spinning barrel is lessened because the barrel is round. The pressure from the impact is distributed over the round surface of the barrel. Instead of belly-flopping upon the water or foam at the bottom of the Falls, the barrel may spin even more because of the pressure distribution.

SUMMARY OF THE INVENTION

A feature of the present invention is the provision in a residential house, of a tensioned sheet of material that provides a structural feature to the house. One preferred structural feature is a wall or wall panel of the house. The tensioned sheet of material is bent without being broken and the concave face of the tensioned curved sheet of material provides an interior living space to the house.

Another feature of the present invention is the provision in such a residential house, of a pair of tensioned wall panels that face one another to make up the walls of the house.

Another feature of the present invention is the provision in a residential house having a tensioned sheet of material, of a counter opposing the tensioned curved sheet to fix the sheet of material in its curved configuration. Where the tensioned sheet of material is a wall or wall panel, the counter may include 1) the roof or rafters or a support network for the roof or rafters, 2) the floor or a support for the floor, 3) the walls or wall panels themselves where two or more walls or wall panels face each other and their end edges are engaged, and/or 4) circumferential windings such as straps running about the convex surfaces of the tensioned walls or wall panels.

Another feature of the present invention is the provision in a residential house having a tensioned sheet of material, of the material being selected from a material that includes or consists of oriented strand board, plastic, cement, steel, or organic material such as grass. Oriented strand board is preferred.

Another feature of the present invention is the provision in a residential house having a tensioned sheet of material, of a method for building the residential house where the tensioned sheet of material is bent without being broken by first bending the sheet of material at a medial portion and then continuing to bend the sheet of material in each of the two directions away from the medial portion where the bending was initiated.

Another feature of the present invention is the provision in a residential house having a tensioned sheet of material, of the tensioned sheet of material being self-supporting on edge. The tension sheet of material requires no studs for supports. The residential house is studless.

An advantage of the present invention is cost. A residential house built according to the present invention may cost less than $1000 at 1998 prices. One feature contributing to the low cost is the cost of materials; the walls of a residential house may be built from only two pieces: two sheets of material, preferably two jumbo sheets of oriented strand board. Other materials are minimal and basic, such as rafters, roof panels, steel straps for counters, a door, door framing, window framing if desired, and pin connectors. Another feature contributing to the low cost is the ease of placing the materials in condition to be shipped. Here minimal steps are required, such as 1) marking the rafters, roof panels, door and window framing to indicate how such components are to be cut at the building site or 2) cutting at the factory such components. Another feature contributing to the low cost is the ease of shipping: the sheets of material may be shipped in flat form to be later bent under tension at the building site. Other components, whether cut or marked for cutting, are also in a flat form. Yet another feature contributing to the low cost is that unskilled labor may be used: the present residential home is easy to erect at the building site.

Another advantage of the present invention is strength. One feature contributing to this advantage is the tensioned wall. The tensioned wall is a rigid wall that is strong on edge.

Another advantage of the present invention is resiliency. One feature contributing to this advantage is the tensioned wall. The tensioned wall is forgiving. A flying or falling branch may bounce off the wall.

Another advantage of the present invention is pressure distribution. One feature contributing to this advantage is the curve of the tensioned wall. High winds spin off of any point on the curved surface of the tensioned wall.

Another advantage of the present invention is weight. The building set of materials is relatively light.

Another advantage of the present invention is size. The size of the finished home is maximized relative to the minimum amount of material that is used.

BRIEF DESCRIPTION OF THE DRAWINGS

The illustrative embodiments may be best described by reference to the accompanying drawings where:

FIG. 18A shows a top view of the central ring of FIG. 17C.

FIG. 18B shows a top view of an alternate embodiment of the central ring of FIG. 18A.

FIG. 18C shows a perspective view of a tie between the central ring of FIG. 18A and the radial beam of FIG. 17A.

FIG. 18D shows a side view of the tie of FIG. 18C.

FIG. 18E shows an alternate embodiment of the tie of FIG. 18C.

DESCRIPTION

Figure 8:
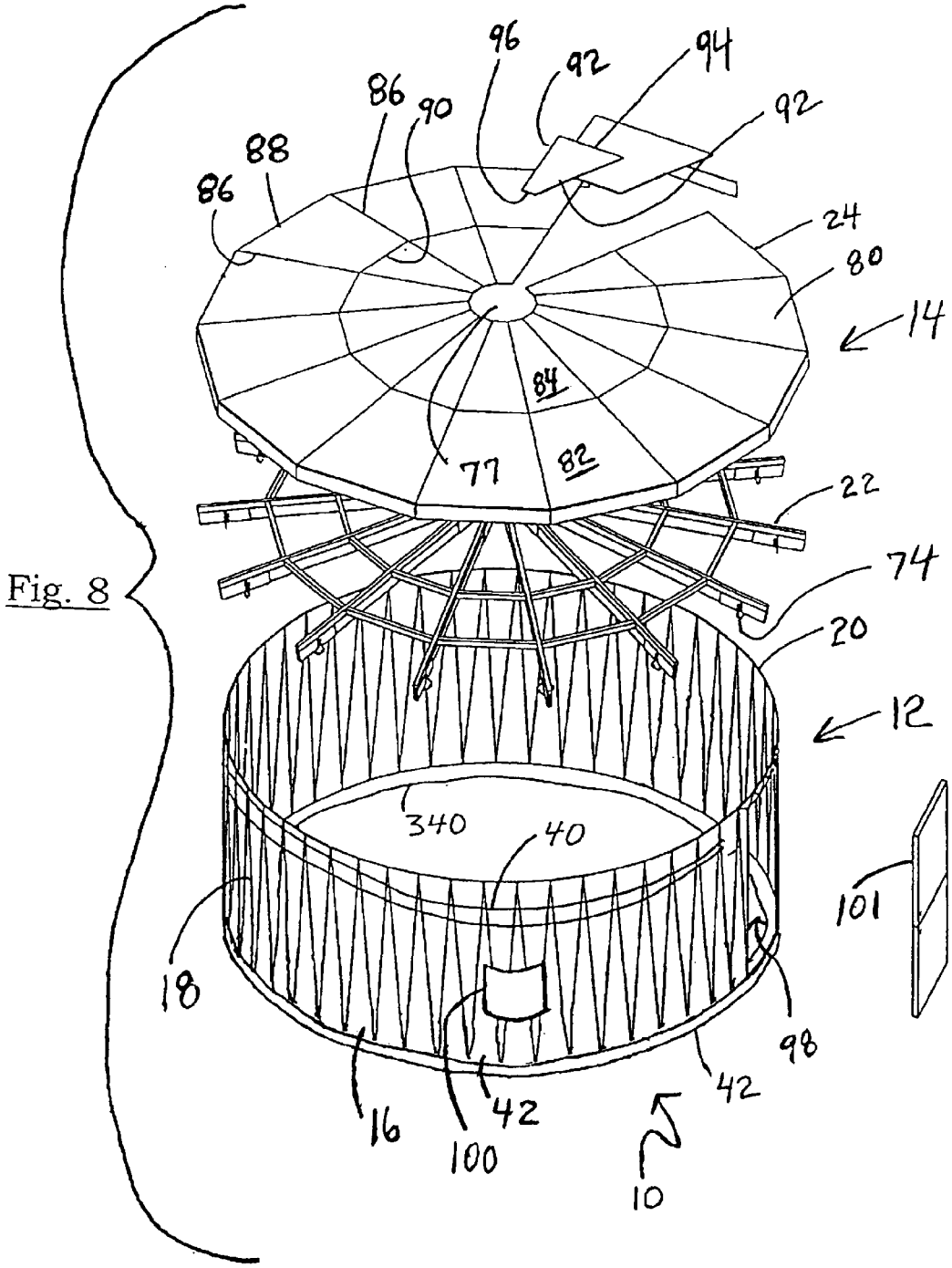
FIG. 8 shows an exploded view of the present residential house.

The structure of the present residential home 10 may be most readily understood by reference to FIG. 8. The home 10 includes an endless tensioned wall 12, a roof 14, and at least one counter 16 for opposing the tension in the wall 12. The endless wall 12 includes a pair of tensioned wall panels 18, 20. The roof 14 includes a rafter network 22 and a pie shaped panel set 24. The counter 16 is a stainless steel strap.

Figure 1:
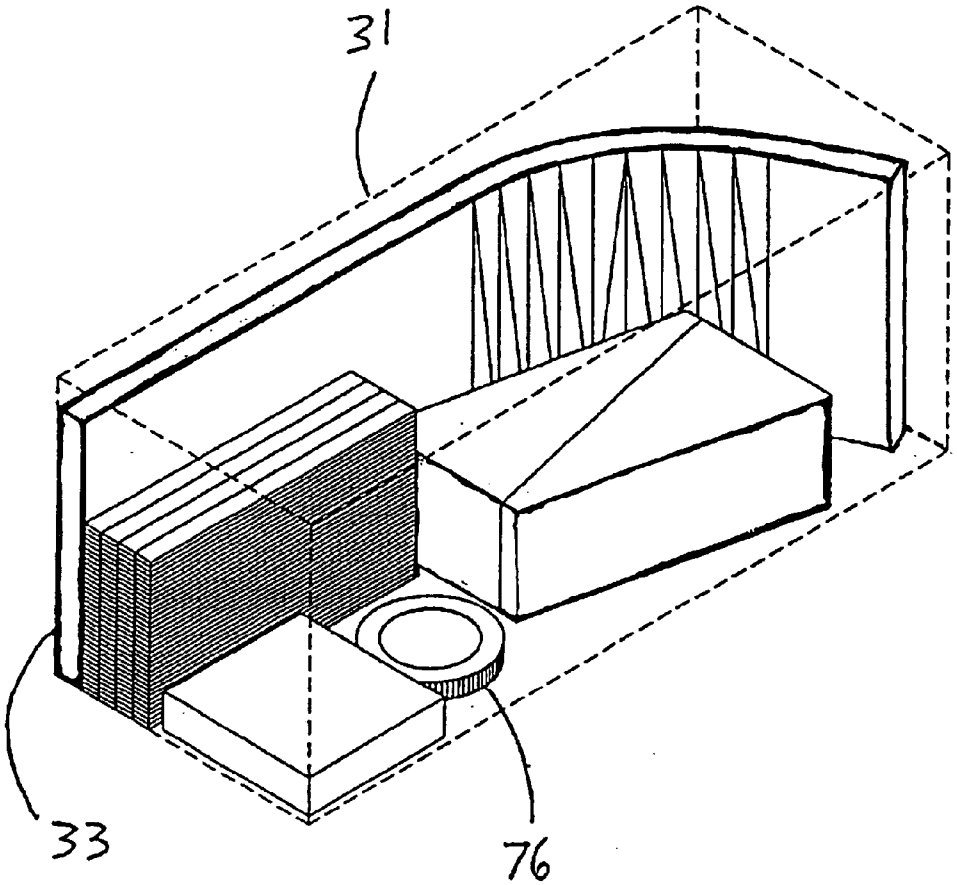
FIG. 1 is an elevation view of the building materials for the present residential house in a carton ready for shipping.

As shown in FIG. 1, a set of homes 10 may be shipped in one carton 31 measuring about 19½ feet in length, about 7½ feet in width, and about 7½ feet deep. The carton 31, and thus at least nine homes, may be shipped by air. FIG. 1 is not exhaustive. For example, a plurality of rings 76 are to be included in the shipping carton 31. At least eighteen wall panels 18 or 20 may be included in the carton 31 and this set of eighteen wall panels 18, 20 is indicated by reference numeral 33. Wall panels 18, 20 are shipped in a partially tensioned form.

Figure 2:
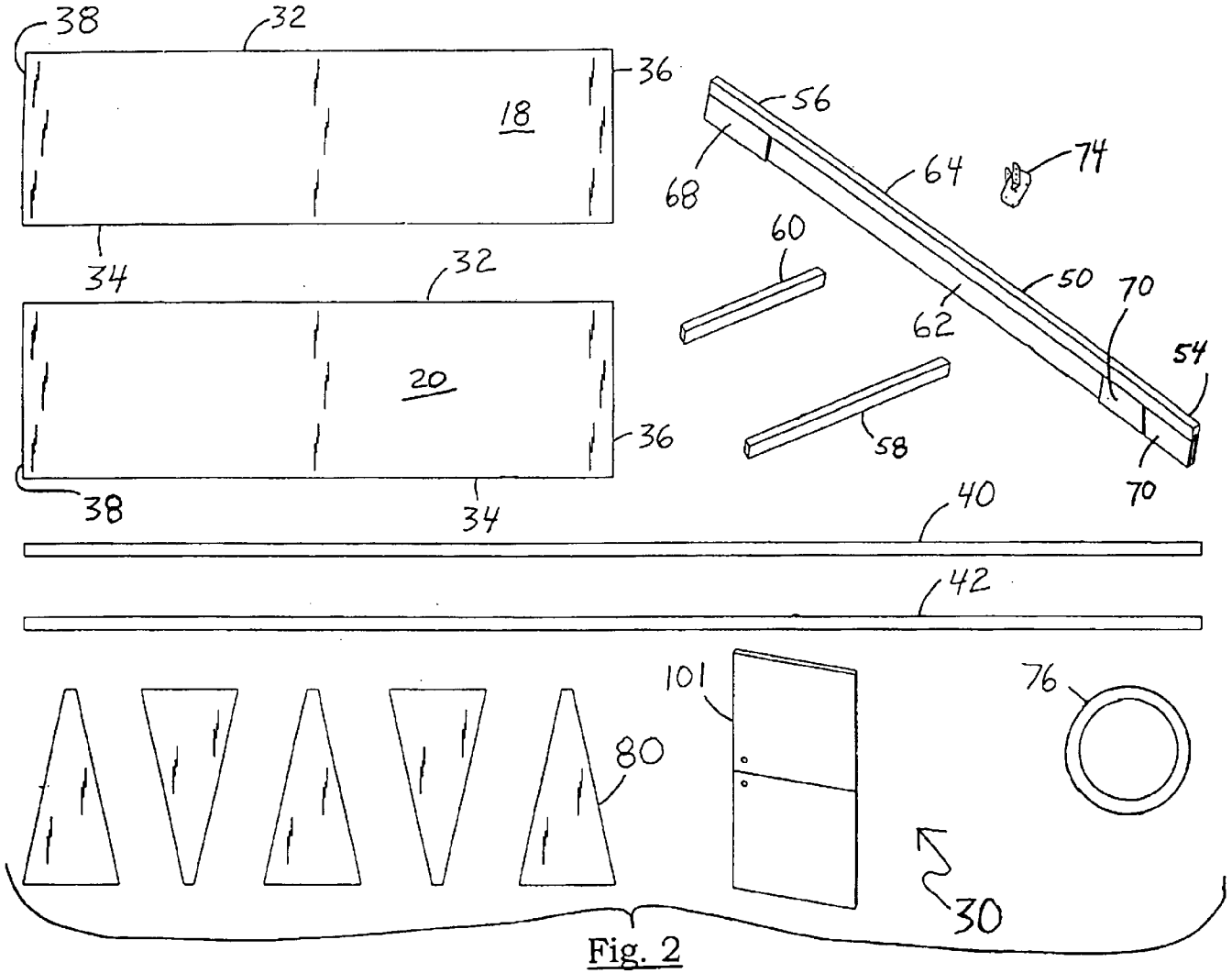
FIG. 2 is an exploded view of the building materials of FIG. 1.
Figure 3A:
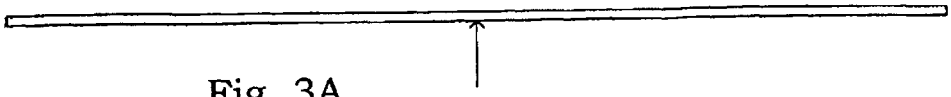
FIGS. 3A–3D illustrate one method of bending a sheet of a material such as a sheet of oriented strand board.
Figure 3B:
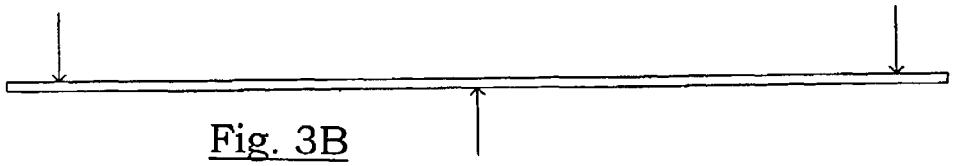
Figure 3C:
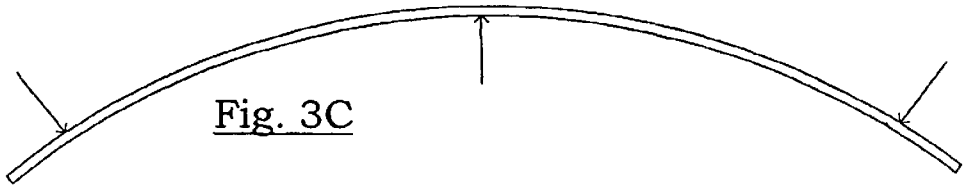
Figure 3D:
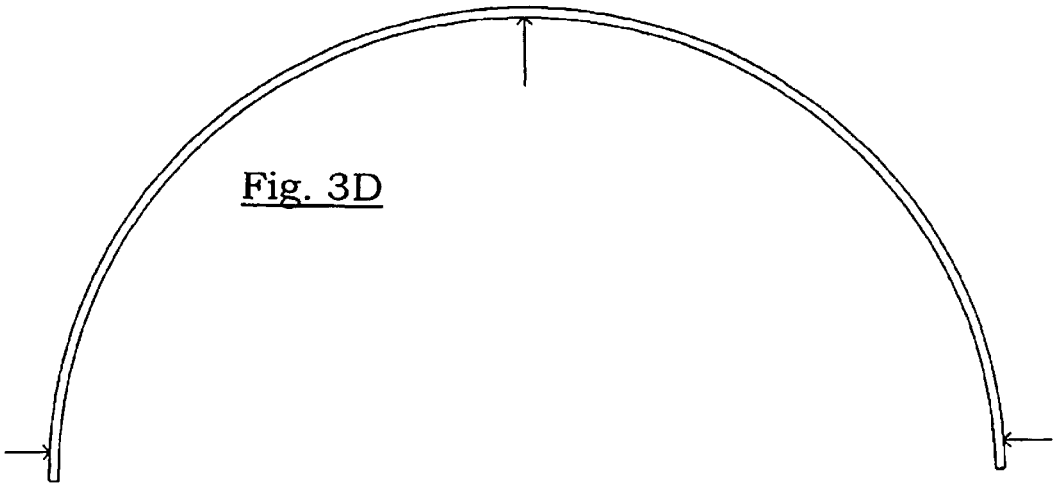
Figure 4A:
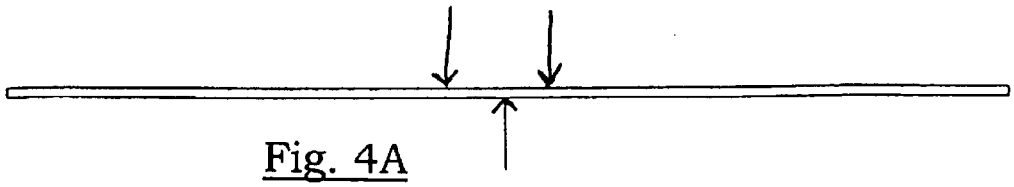
FIGS. 4A–4D illustrate another method of bending a sheet of a material such as a sheet of oriented strand board.
Figure 4B:
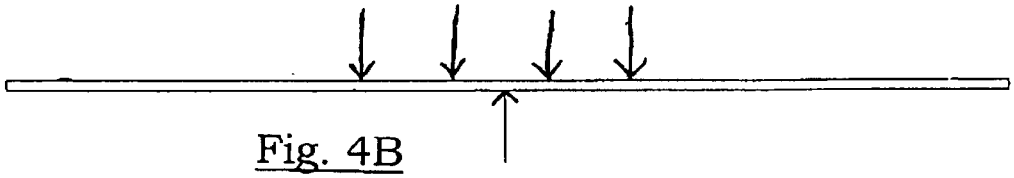
Figure 4C:
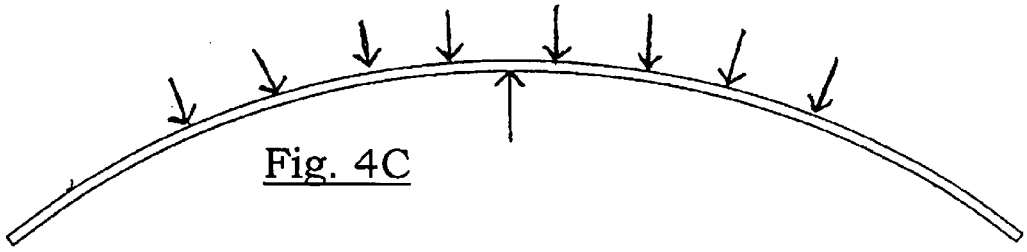
Figure 4D:
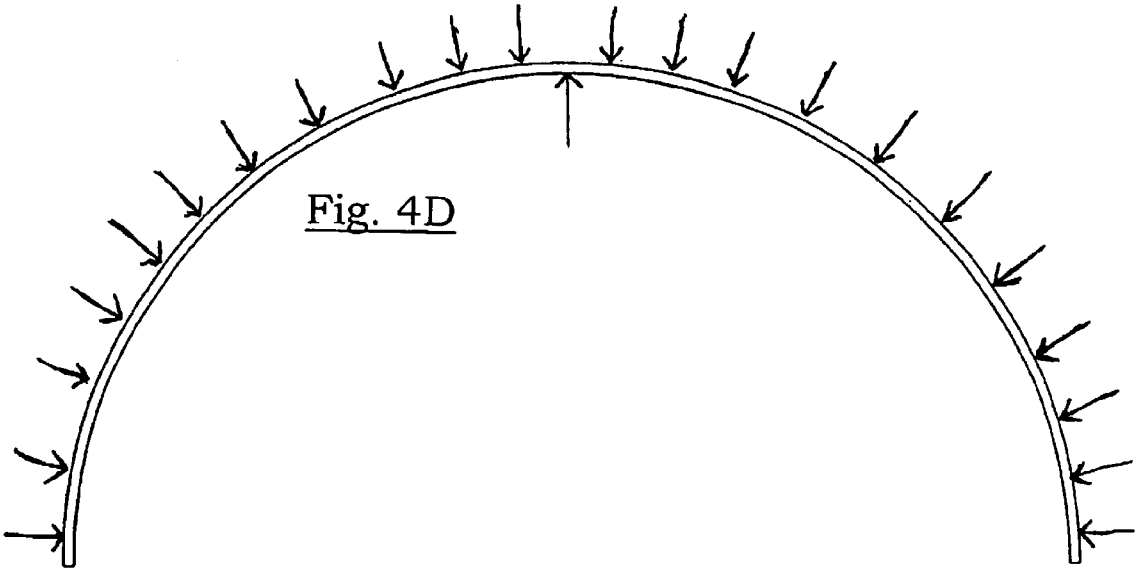
Figure 5A:
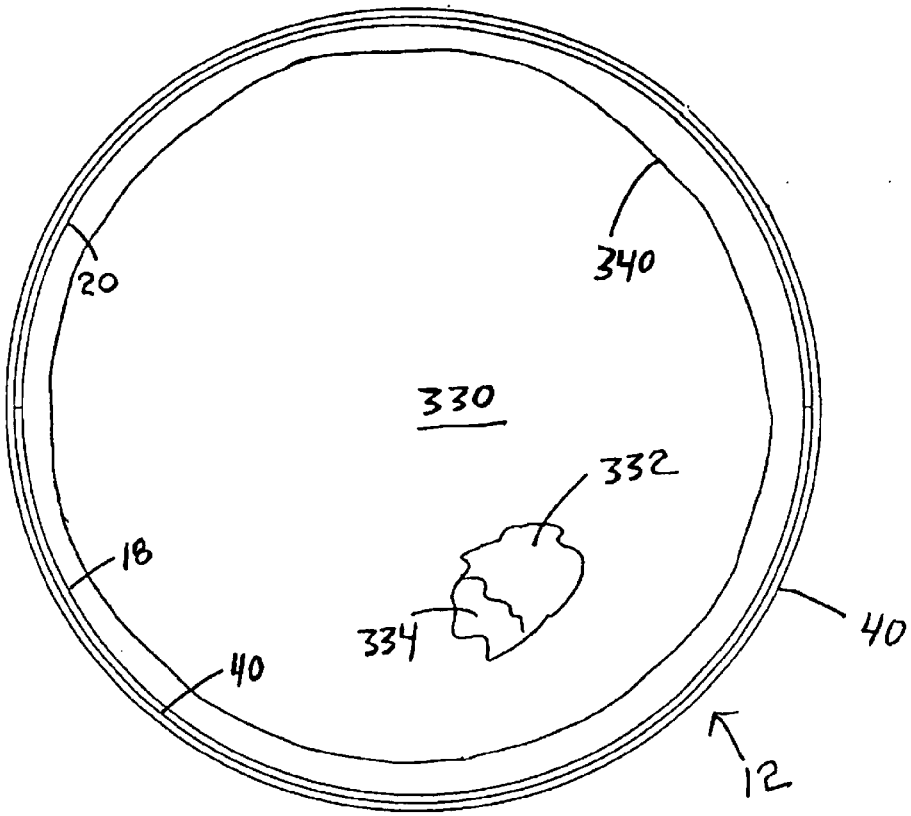
FIG. 5A shows a top view of the endless wall of the present residential house formed by bending two sheets and countering the tension in the two sheets by running a strap about the two sheets.
Figure 5B:
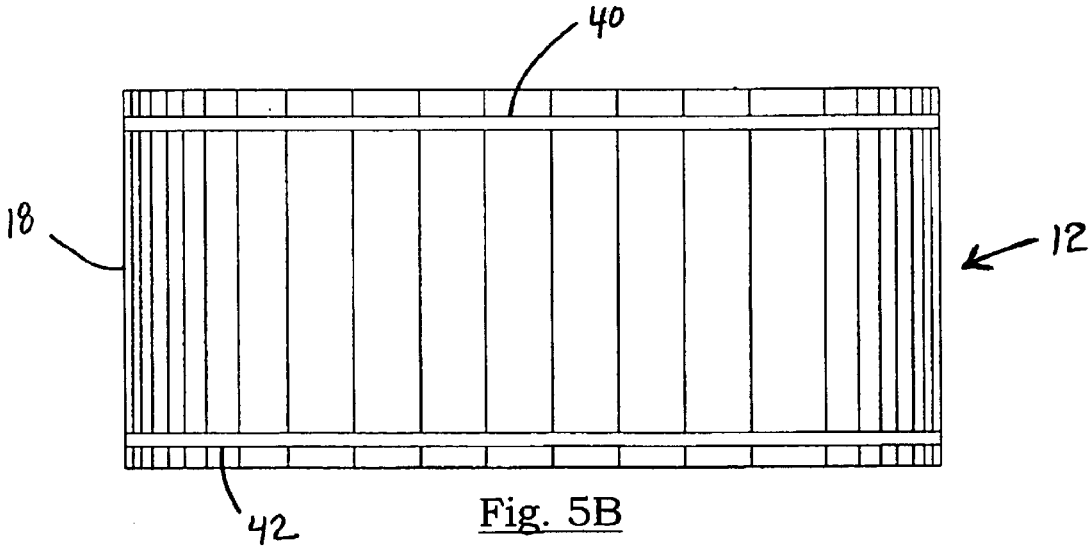
FIG. 5B shows a side view of the endless wall of FIG. 5A.
Figure 6A:
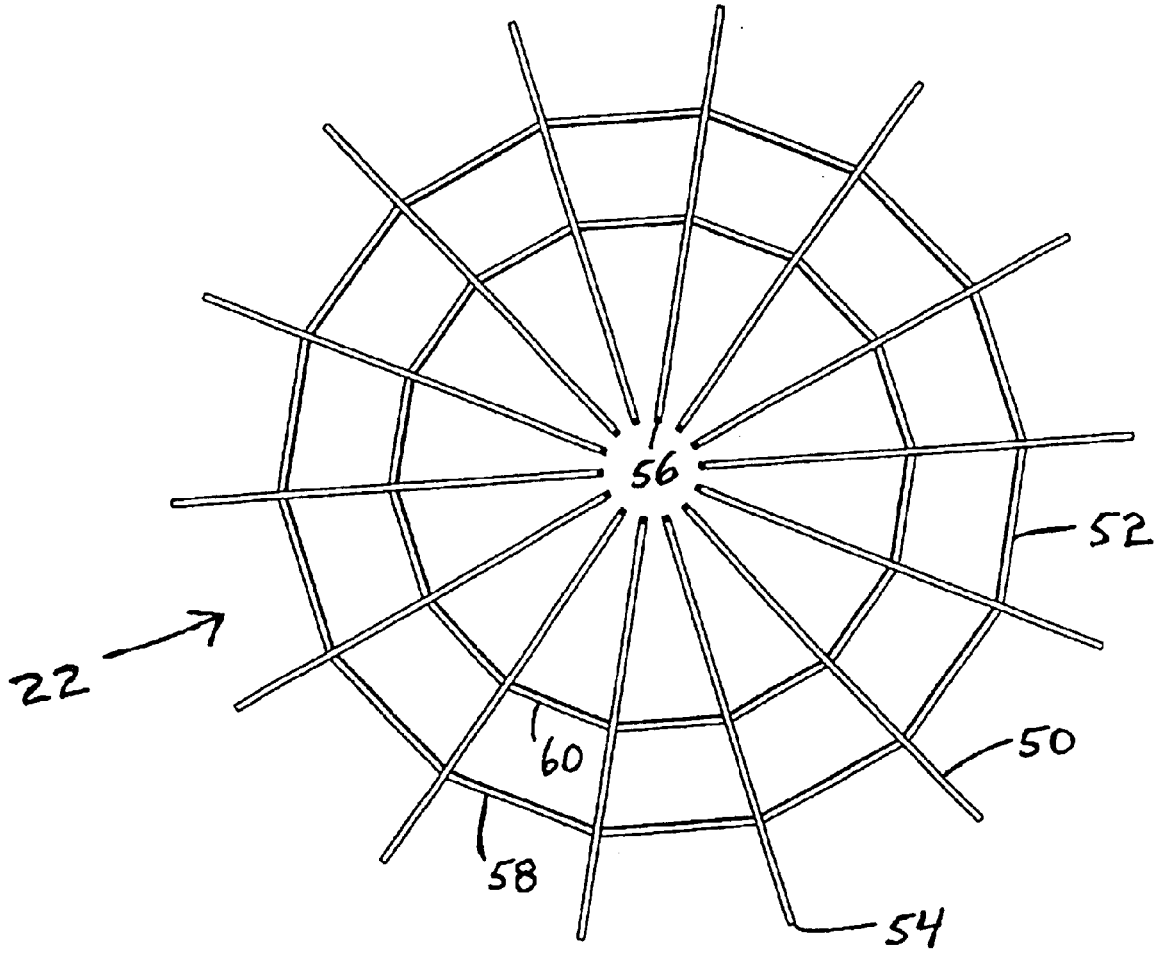
FIG. 6A shows a top view of the rafter network for the present residential house.
Figure 6B:
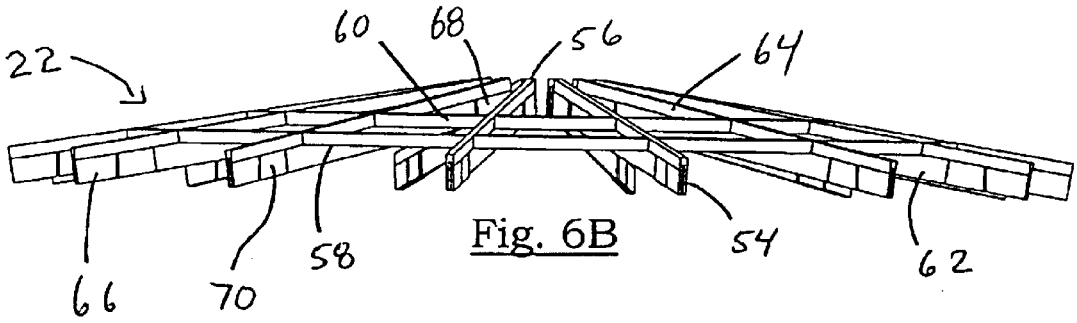
FIG. 6B shows a side view of the rafter network of FIG. 6A.
Figure 6C:
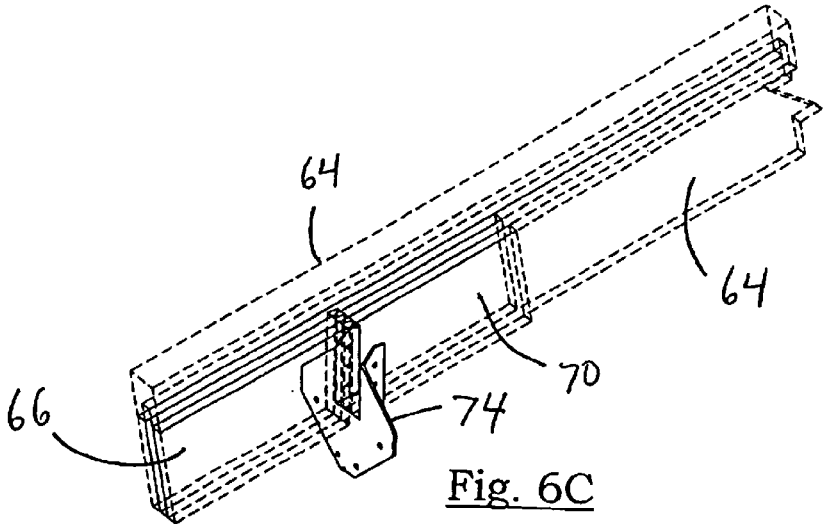
FIG. 6C shows a section of one portion of the rafter network of FIG. 6A.
Figure 7A:
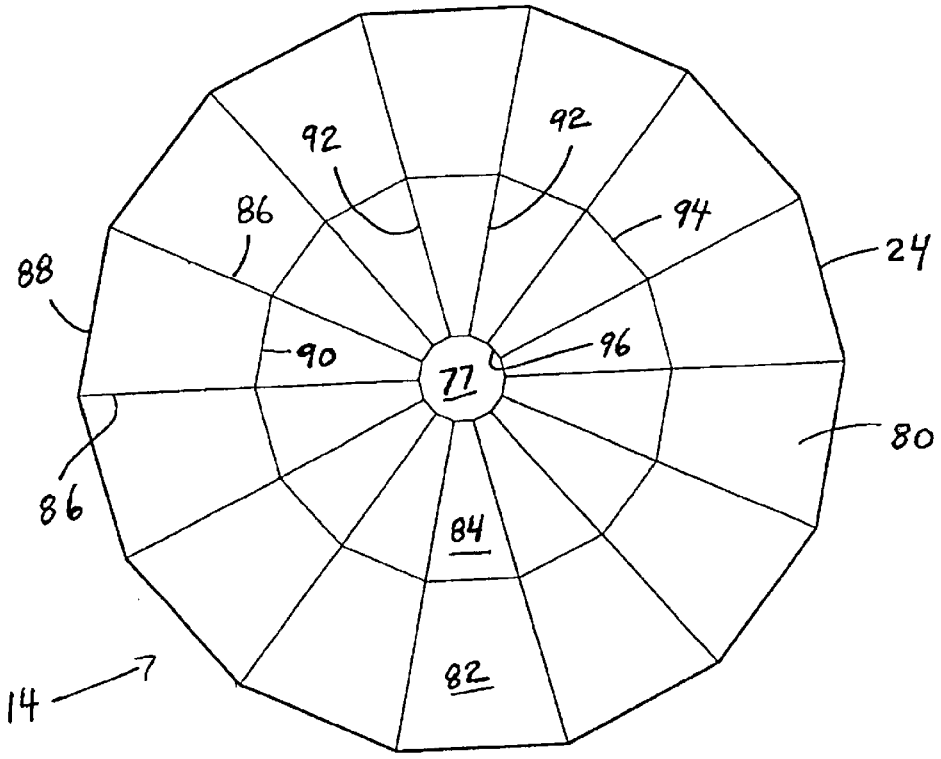
FIG. 7A shows a top view of the roof panels for the present residential house.
Figure 7B:
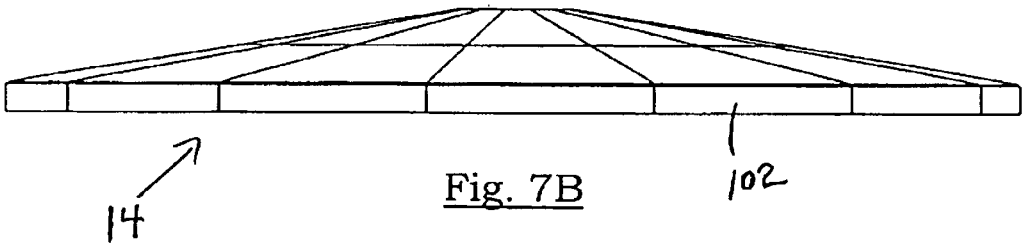
FIG. 7B shows a side view of the roof panels of FIG. 7A.

As shown in FIG. 2, the home 10 is built with a relatively small, light and inexpensive set 30 of building materials. The set 30 of building materials costs at 1998 prices less than $1000. FIG. 2 is diagrammatic and is intended to give a general idea of the materials included in the home 10. FIG. 2 is not exhaustive.

As shown in FIGS. 2, 5A, 5B and 8, each of the wall panels 18, 20 is one-piece. The height of each of the wall panels 18, 20 is defined by the distance between upper edge 32 and lower edge 34 and is preferably greater than the height of an average adult male. The length or width of the wall panel is defined by the distance along the panel between end edges 36, 38. Of course, when the wall panels 18, 20 are placed under tension, the direct distance between the end edges 36, 38 decreases. The thickness of the wall panel is preferably between about ¼ inch and about 2.0 inches, more preferably between about ⅜ inch and about 1.5 inches, and most preferably between about 7⁄16 inch and 1.25 inches.

The material for the wall panels 18, 20 is preferably selected from a material comprising steel, concrete, plastic, or organic substances such as grass and wood. More preferably, such material includes grass or wood. Most preferably, such material is wood.

Of wooden materials, preferred are engineered wood materials such as plywood and oriented strand board. Of engineered wood materials, most preferred is oriented strand board.

Wall panels 18, 20 are flat in a nontensioned form. In a tensioned form where the wall panels 18, 20 are bent to a circular shape, the wall panels 18, 20 do not split. The material selected for the wall panels 18, 20 preferably includes these flat and split resistant characteristics. The wood strands of oriented strand board and the grass of grass based materials are features that permit both a bending without breaking and a bending without splitting.

Wall panels 18, 20 are preferably formed of a material that is insulative. Maple, oak, and similar hardwoods have an R value of about 0.91 per inch of thickness. Fir, pine and similar woods have an R value of about 1.25 per inch of thickness. Hardboard has an R value of about 1.37 per inch of thickness. Oriented strand board has an R value of about 0.45, 0.51, 0.62, 0.74 and 0.91 for nominal panel thicknesses of ⅜ inches, 7/16 inches, ½ inches, ⅝ inches and ¾ inches, respectively. The thermal resistance R is measured in units of (feet$^2$×hour×degrees Fahrenheit)/Btu. As to R values, the book Superinsulated Home Book, authored by J. D. Ned Nisson and Michael L. Webb, copyright 1985, published by John Wiley & Sons, New York, is hereby incorporated by reference in its entirety. For the wall panels 18, 20, the R value is preferably between about 0.45 and about 1.5. An R value of greater than 1.5 for the wall panel itself is even more preferred, although the cost of such a highly engineered panel may be prohibitive. Instead, conventional insulation may surround the wall panels 18, 20 or may be fixed to the inside face of the panels 18, 20.

Wall panels 18, 20 are preferably formed of a material that is resistant to the permeance of water vapor. More preferably, wall panels 18, 20 are formed of a material that is substantially impermeable to water vapor. As to permeance, the book Superinsulated Home Book, authored by J. D. Ned Nisson and Michael L. Webb, copyright 1985, published by John Wiley & Sons, New York, is hereby incorporated by reference in its entirety. A permeance value of 1.0 perm means that under a vapor pressure differential of 1.0 inch of mercury, 1.0 grain per hour of water vapor will diffuse through each square foot of surface. One-eighth inch of standard hardboard has a permeance value of 11. One-eighth inch of tempered hardboard has a permeance value of 5. Exterior plywood has a permeance of 0.7. Interior plywood has a permeance value of 1.9. Polyethylene has a permeance value of 0.08, 0.06, and 0.04 for thickness of 4 mil, 6 mil, and 8 mil, respectively. Aluminum foil has a permeance value of 0.0. Oriented strand board with nominal panel thicknesses of ⅜ inches, 7/16 inches, ½ inches and ⅝ inches have permeance values of 2.55, 1.95, 1.55 and 1.1, respectively. Wall panels 18, 20 preferably have a water vapor permeance value of between about 2.55 perm and about 0.05 perm, more preferably between about 1.95 perm and about 0.05 perm.

Wall panels 18, 20 preferably provides a nail base. Wall panels 18, 20 more preferably provide nail base at generally any location between the upper and lower edges 32 and 34 and between the end edges 36 and 38.

Wall panels 18, 20 preferably have sufficient rigidity between the upper and lower edges 32 and 34 to support a roof and to further support a live load on the roof As shown in FIGS. 2, 5A, 5B and 8, one embodiment of the counter 16 includes a pair of stainless steel straps 40, 42. Upper strap 40 surrounds an upper portion of each of the wall panels 18, 20. Lower strap 42 surrounds a lower portion of each of the wall panels 18, 20. The opposite ends of the respective straps 40, 42 are fastened to each other to fix the wall panels 18, 20 in their tensioned forms. When such opposite ends are fastened to each other, each of the straps 40, 42 effectively becomes an endless strap.

Figure 11:
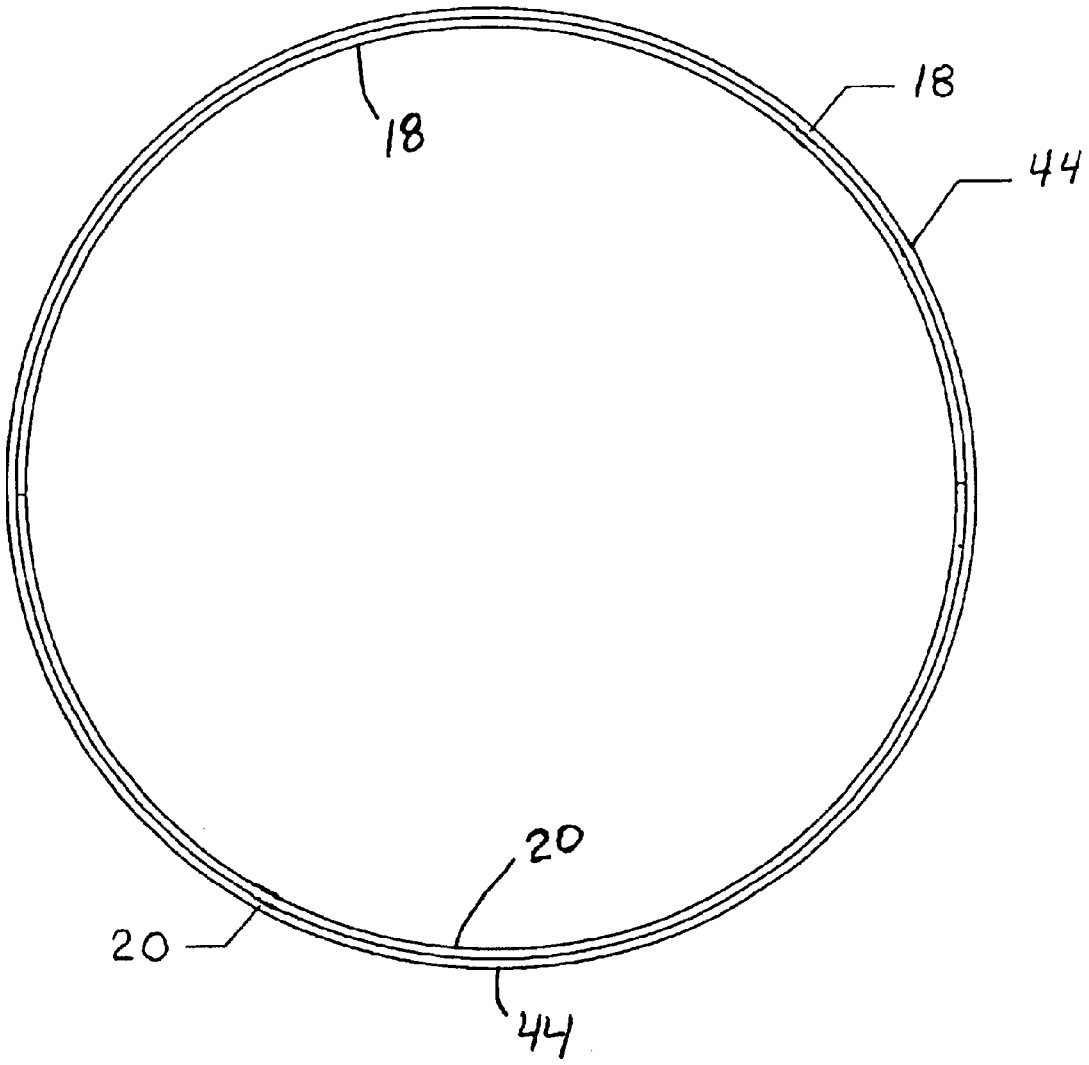
FIG. 11 shown another embodiment of the counter, specifically a floor level cement ring.

Another counter that may be used is the rafter network 22. Another counter that may be used in combination with the straps 40, 42 is a floor level cement ring 44, as shown in FIG. 11. Cement ring .44 may be used whether the floor is dirt, wood, or cement. Where the rafter network 22 and cement ring 44 are used in combination, straps 40 and 42 may not be required. However, steel straps 40 and 42 are preferred to lend a more permanent nature to the home. Further, steel straps 40 and 42 lend self supporting features to the home 10. That is, should the concrete foundation or cement ring 44 break such as during an earthquake, the wall panels 18 and 20 are more likely to stay in their tensioned configurations by virtue of the steel straps 40, 42.

As shown in FIGS. 2, 6A, 6B, and 8, the rafter network 22 includes radial beams 50 radiating from upper edges 32 of the wall panels 18, 20 toward a center of the home 10 and transverse beams 52 running between the radial beams 50. Each of the radial beams 50 includes an outer end 54 and an inner end 56. Radial beam 50 is preferably one-piece from its outer end 54, which is engaged to a portion of wall panel upper edge 32, to its inner end 56, which terminates near the center of the home 10. Transverse beams 52 include outer transverse beams 58 and inner transverse beams 60.

Radial beam 50 is an I-beam hybrid. Radial beam 50 includes a web 62 and only one flange 64, where a conventional I-beam includes two opposing flanges. Web 62 is mounted in a slot formed in the flange 64. Radial beam 50 further includes a pair of web stiffeners 66 at the outer end 54 and a pair or web stiffeners 68 at the inner end 56. Each of the pairs of web stiffeners 66 includes two stiffener panels 70 mounted on either face of web 62. Stiffener panels 70 have upper edges that abut the lower edge of flange 64.

The outer and inner transverse beams 58 and 60 are engaged to the flanges 64 of the beams 50 with pin connectors such as nails, staples and screws. Outer transverse beams 58 form one effective ring about the support network 22. Inner transverse beams 60 form a second effective ring about the support network 22.

A slot 72 is formed in the outer end or outer end portion 54 of radial beam 50. Slot 72 runs through both stiffener panels 70 and web 62 and runs from the lower edges of stiffener panels 70 and web 62 to the lower edge of flange 64. Slot 72 receives a portion of the upper edge 32 of wall panels 18, 20 so as to engage such wall panels 18, 20. Slot 72 is oblique relative to the lower edges of the web 62 and stiffener panels 70 to permit radial beam 50 to run upwardly (an inwardly) toward a center axis of home 10 such that rain runs off the roof 24.

Support network 22 further includes a finned metal tie plate 74 engaged by pin connectors in the slot 72 so as to further engage or tie in the wall panels 18 and 20 to the radial beams 50. Metal tie plate 74 is tied to wall panels 18, 20 with pin connectors.

Support network 22 further includes an angle iron in the shape of a metal ring 76 to which are engaged via pin connectors the inner ends 56 of radial beams 50. A metal or hard plastic are the preferred materials for the ring 76 so as to contribute to a permanent nature for the home 10 because ring 60, in combination with the radial beams 50, is a counter opposing the tensioned wall panels 18, 20. Metal ring 76 preferably includes a diameter about that of a manhole to permit resident access to the roof. Metal ring 76 forms an opening 77 that preferably is left open to permit smoke, steam and other gases to vent in the natural upward direction.

It should be noted that, in the construction of the support network 22, a central post may be used so at to provide support for the metal ring 76 or for the inner ends 56 of the radial beams 50. The central post may or may not be taken out upon completion of the support network 22.

Roof 24 is a structural part of the support network 22 because the roof 24 includes decking or roof panels or roof sheathing 80 that tie in radial beams 50 with other radial beams 50, transverse beams 52 with other transverse beams 52, and radial beams 50 with transverse beams 52. Roof panels 80 are engaged to the flanges 64 with pin connectors. Roof panels 80 include perimeter roof panels 82 and inner roof panels 84. Each of the perimeter panels 82 includes a pair of side opposing edges 86 running towards each other and a pair of outer and inner edges 88, 90 which are parallel to each other. Each of the inner panels 84 includes a pair of side opposing edges 92 running towards each other. Each of the inner panels 84 further includes an outer edge 94, which abuts inner edge 90 of perimeter panel 82, and an inner edge 96. Inner edge 96 is preferably circular so as to run up flush to metal ring 76. Roof panels 80 are preferably formed of the same material as the wall panels 18, 20. Most preferably, roof panels 80 are oriented strand board.

Wall 12, or wall panels or portions 18, 20, may include door openings 98 and window openings 100. Door opening 98 is preferably formed by spacing the end edges of opposing wall panels 18, 20 from each other. Metal straps 40 and 42 are sufficiently low and sufficiently high so as to allow free and safe passage through door opening 98 without a tripping over lower strap 42 and without a ducking of the head 40 to avoid upper strap 40. Window and door openings 98 and 100 may be framed in a conventional manner since the curve of the wall panels 18, 20 is gradual. The set 30 may include a door 101.

Figure 9A:
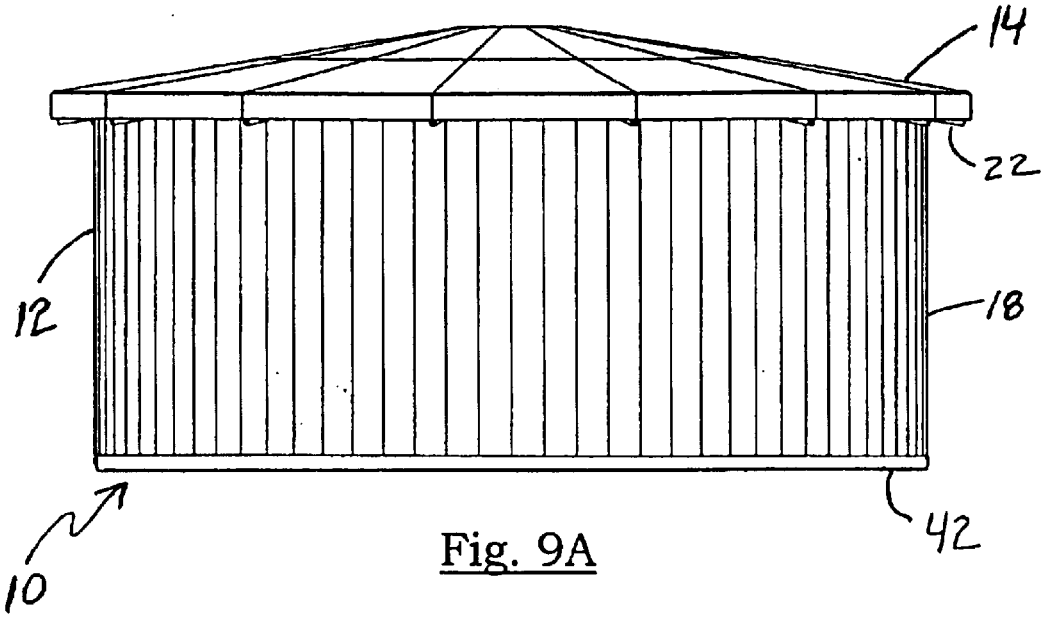
FIG. 9A shows a side view of the present residential house.
Figure 9B:
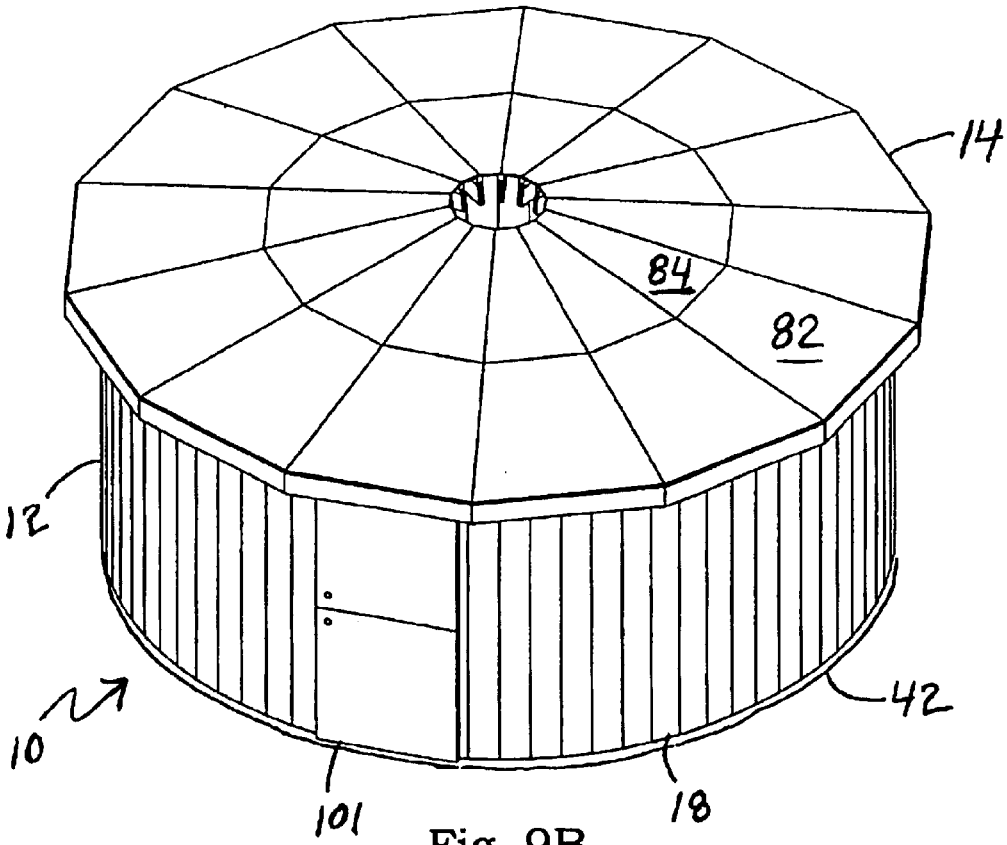
FIG. 9B shows a perspective view of the residential house of FIG. 9A.

As shown in FIGS. 9A and 9B, roof 24 may include fascia panels 102. Each of the fascia panels 102 runs between the outer ends 54 of two radial beams 50 and is engaged thereto via pin connectors.

Figure 10A:
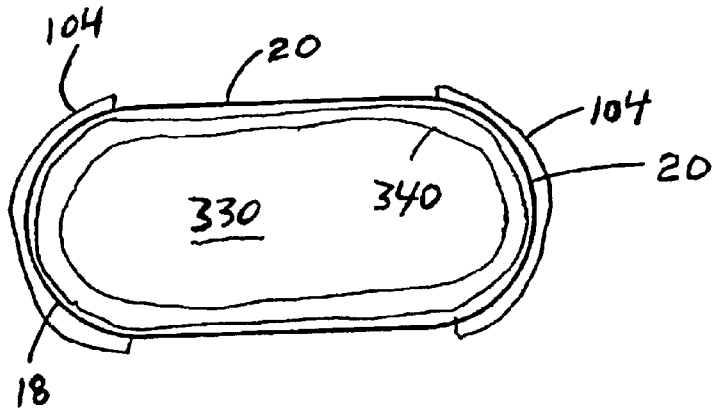
FIG. 10A shows a diagrammatic view of another embodiment for the walls of the present residential house where to generally linear walls are engaged between two curved tensioned walls.
Figure 10B:
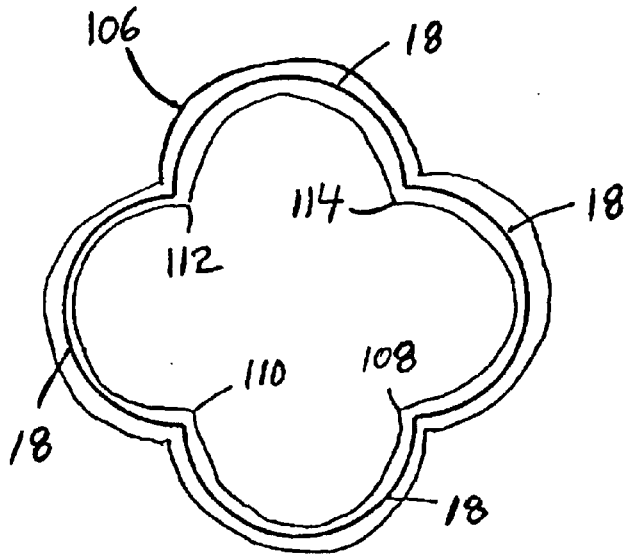
FIG. 10B shows a diagrammatic view of still another embodiment for the walls of the present residential house where a set of four tensioned walls form a clover leaf pattern.
Figure 10C:
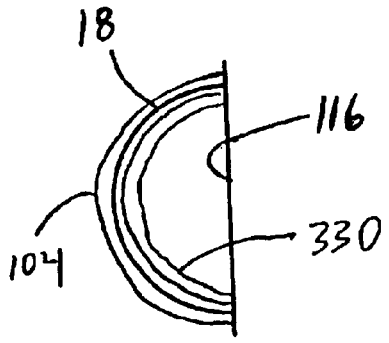
FIG. 10C shows a diagrammatic view of yet another embodiment for the walls of the present residential house where only one tensioned wall forms a house or a portion of a house.

As shown in FIGS. 10A, 10B, and 10C, home 10 may take configurations other than a general circle. For example, FIG. 10A shows two tensioned wall panels 18, 20 disposed between two nontensioned wall panels 18 and 20 which may act as counters fixing the tensioned wall panels 18*k*, 20 in their fixed tensioned positions. Or a cement floor having a perimetrical flange (similar to the cement ring 44) or a pair of cement perimetrical flanges 104 may be used as lower counters and a rafter network may be used as an upper counter. In such an embodiment, the confronting upright end edges of the tensioned and nontensioned panels 18, 20 may be fixed to each other. Doors and window openings may be formed in the nontensioned wall panels.

FIG. 10B shows a four leaf clover pattern. Here a cement perimetrical flange 106 also formed in the four leaf clover pattern may be used as a lower counter. A rafter network may be used as an upper counter and may connect locations such as locations 108, 110, 112, and 114.

FIG. 10C shows an embodiment where one wall panel 18 or 20 may form its own home or shelter. Reference numeral 116 is a counter such as a side of a house or a beam or pair of beams.

FIGS. 3A–3D show one method for bending wall panels 18 and 20. Such a method, where the end edges of the sheet are simply turned in, is sufficient where the sheet is relatively thin and easy to bend.

FIGS. 4A–D show another method for bending the wall panels 18 and 20. Here pressure is applied sequentially and incrementally from a medial portion to each of the ends with a tool such as a sliding belt. Alternatively, such pressure may be applied simultaneously with the stainless steel straps 40, 42 of the present invention. Such a sequential or simultaneous bend may be preferred for thicker sheets of material.

Another method of bending without breaking a sheet of material such as oriented strand board is to begin a bending at one end of the sheet material and continue to bend the sheet material sequentially and incrementally from such one end to the other end. This method is similar if not identical to the method shown in FIGS. 4A–E, except that the medial portion is adjacent to one end of the sheet material.

Oriented strand board is a wood product and hence reacts to moisture or to changes in moisture. At the same time, oriented strand board includes a waterproof and boilproof binder that is preferably a thermosetting adhesive binder which when fully cured is not softened by moisture or heat. These binders, such as phenol formaldehyde and isocyanate binders, are insoluble heat-resistant polymers that resist aging, moisture and chemical degradation.

As to oriented strand board, the chapter "Composition Board," *Encyclopedia of Polymer Science and Engineering*, 1986, pp. 47–67, Volume 4, John Wiley & Sons, New York, is hereby incorporated by reference in its entirety. Further as to oriented strand board, the chapter "Wood," *Encyclopedia of Polymer Science and Engineering*, 1989, pp. 843–887, Volume 17, John Wiley & Sons, New York, is hereby incorporated by reference in its entirety.

Oriented strand board is a mat-formed panel made of strands sliced in the long direction from small diameter, fast growing round wood logs and bonded with an exterior-type binder under heat and pressure. The fast growing trees include aspen poplar, southern yellow pin. The basic steps for making oriented strand board include a) slicing the logs into strands along the direction of the grain, b) drying and sorting the strands, c) mixing the dried and sorted strands with wax and a waterproof exterior-type binder such as phenolic or isocyanate resin binder, d) orienting the strands by electrical alignment or mechanical alignment, with each layer of strands being laid down separately along a conveyor belt to result in a "mat" which is loosely held together and has no strength, e) sawing the loose mat into lengths and running the loose through a prepress to remove some air and vapor to escape, f) pressing and heating the mat to a specified thickness to cause the resin to cure and to cause an interweaving or tangling of the strands, and g) permitting the pressed mat to cool. The strength of the oriented strand board product is a result of the uninterrupted fiber, interweaving of the strands, and the orientation of the strands.

Oriented strand board is a wood product and hence reacts to moisture or to changes in moisture. At the same time, oriented strand board includes a waterproof and boilproof binder that is preferably a thermosetting adhesive binder which when fully cured is not softened by moisture or heat. These binders, such as phenol formaldehyde and isocyanate binders, are insoluble heat-resistant polymers that resist aging, moisture and chemical degradation. Permeability of a panel of oriented strand board, or the rate that moisture passes through the panel under stated conditions of moisture vapor pressure, is proportional to the density, degree of orientation and thickness of the panel. According to the pamphlet "OSB Performance By Design," copyright 1996 by the Structural Board Association, printed in Canada, the vapor permeance (in perms) of oriented strand board with nominal panel thicknesses of ⅜ inches, 7/16 inches, ½ inches and ⅝ inches is 2.55, 1.95, 1.55 and 1.1, respectively. This pamphlet further states that panel thicknesses of greater than ⅝ inches were not tested, but that it can be assumed that panels having a thickness greater than ⅝ inches, such as ¾ inches, provide a permeability resistance equal to or better than that of ⅝ inch panels.

Oriented strand board is an engineered mat-formed structural panel made of strands sliced from small diameter logs, and bonded with resin under intense heat and pressure. Since the strands are precisely cut to a uniform size and thickness, specific performance qualities can be designed into the panel by cross-aligning layers of wood strands for maximum length. Oriented strand board formed with an aligned face and a random core or an aligned face with a oriented core is preferred. The resin is fully waterproof, and is preferably a waterproof phenolic resin. Oriented strand board possesses great strength and stiffness resulting from the cross-laminated layers. Oriented strand board will not warp. The preferred oriented strand board is graded Exposure I and Structural I. Oriented strand board is not "particle board." Neither is it "flakeboard." Oriented strand board meets performance standards based on the end use for the board. The three basic criteria for qualifying oriented strand board include structural adequacy, dimensional stability and bond durability. Tests for such criteria include linear expansion, racking, uniform load, concentrated static load, impact resistance, direct fastener withdrawal, and lateral fastener strength. Oriented strand board panels are strong. Such panels resist racking and shape distortion under high wind and earthquake forces. Such panels exhibit excellent fastener-holding capability, even when nailed close to the panel edge. Relative to its strength, oriented strand board is lightweight. Such panels have stiffness to resist deflection and bending. They absorb shock. They are made from wood, a natural insulator, and provide protection from heat loss and condensation.

Oriented strand board is a generic structural panel product composed of strands sliced from whole aspen poplar, southern yellow pin or other mixed hardwood logs. The strands are sliced from the logs in the direction of the grain so that the inherent tree strength is maintained in the oriented strand board panel. After slicing, the strands are dried, blended with wax and waterproof exterior type binders such as phenolic resin, then formed into a loose mat or pad containing three to five layers and then pressed under high pressure and heat in the final rigid, dense structural panel, which then may be cut to size. The binder is preferably waterproof and boilproof The strands are oriented in layers during the forming process so that strands on the panel surface generally lay in the direction of the panel's strength. The longitudinal arrangement of the strands in the surface layers increases the strength and stiffness of the panel in the direction of alignment.

Strands for oriented strand board may be up to four and a quarter inch in length and one inch wide. Strands preferably have a uniform thickness.

The strength of oriented strand board is provided by the uninterrupted wood fiber, interleaving of the long strands, and the degree of orientation of the strands in the surface layers. Waterproof and boilproof resin binders further provide internal strength, rigidity and moisture resistance.

Figure 12A:
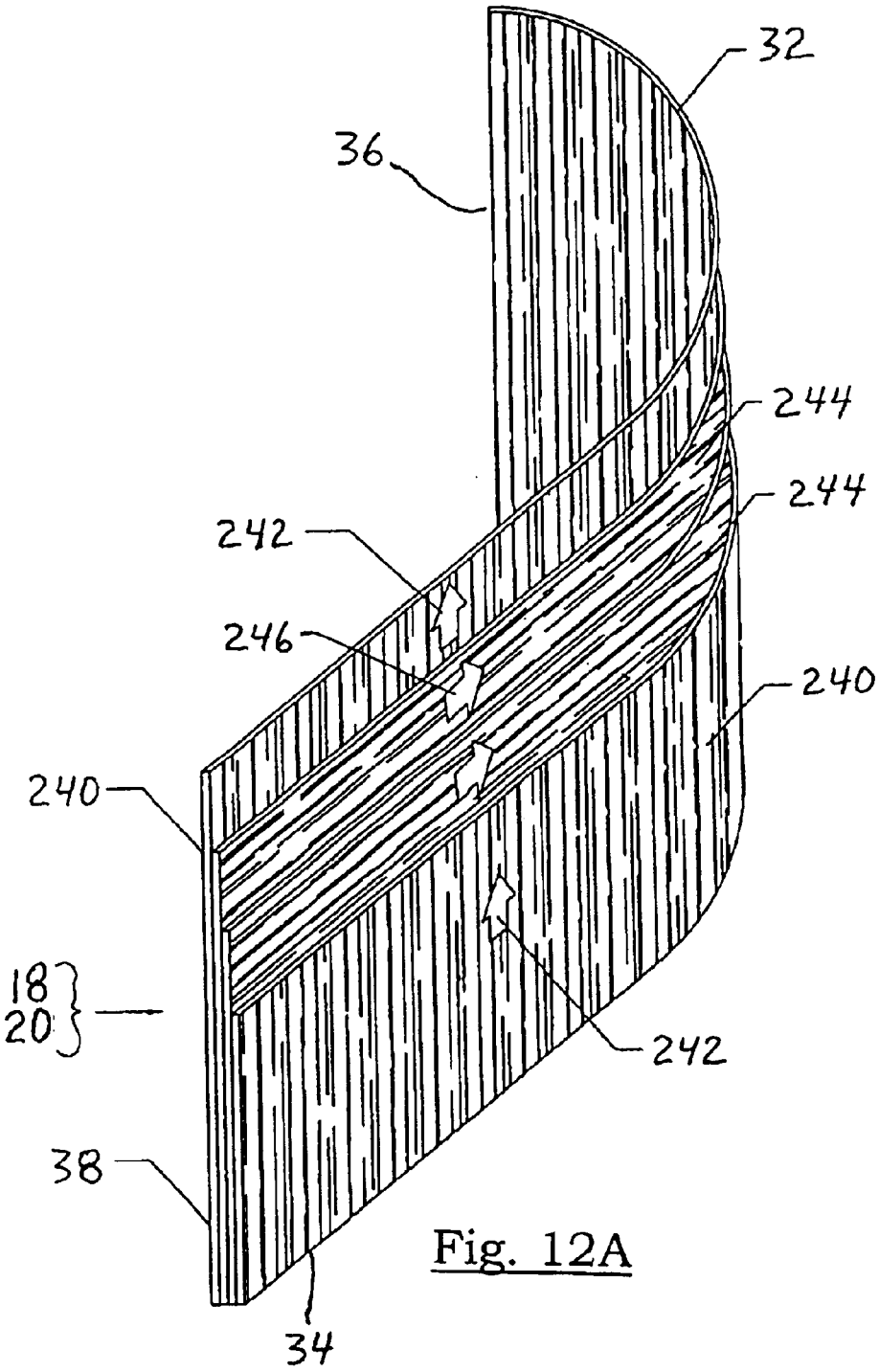
FIG. 12A shows the alignment of the wood strands of the face and core layers of one tensioned wall panel for the present residential house where the wall panel is oriented strand board having an oriented core.
Figure 12B:
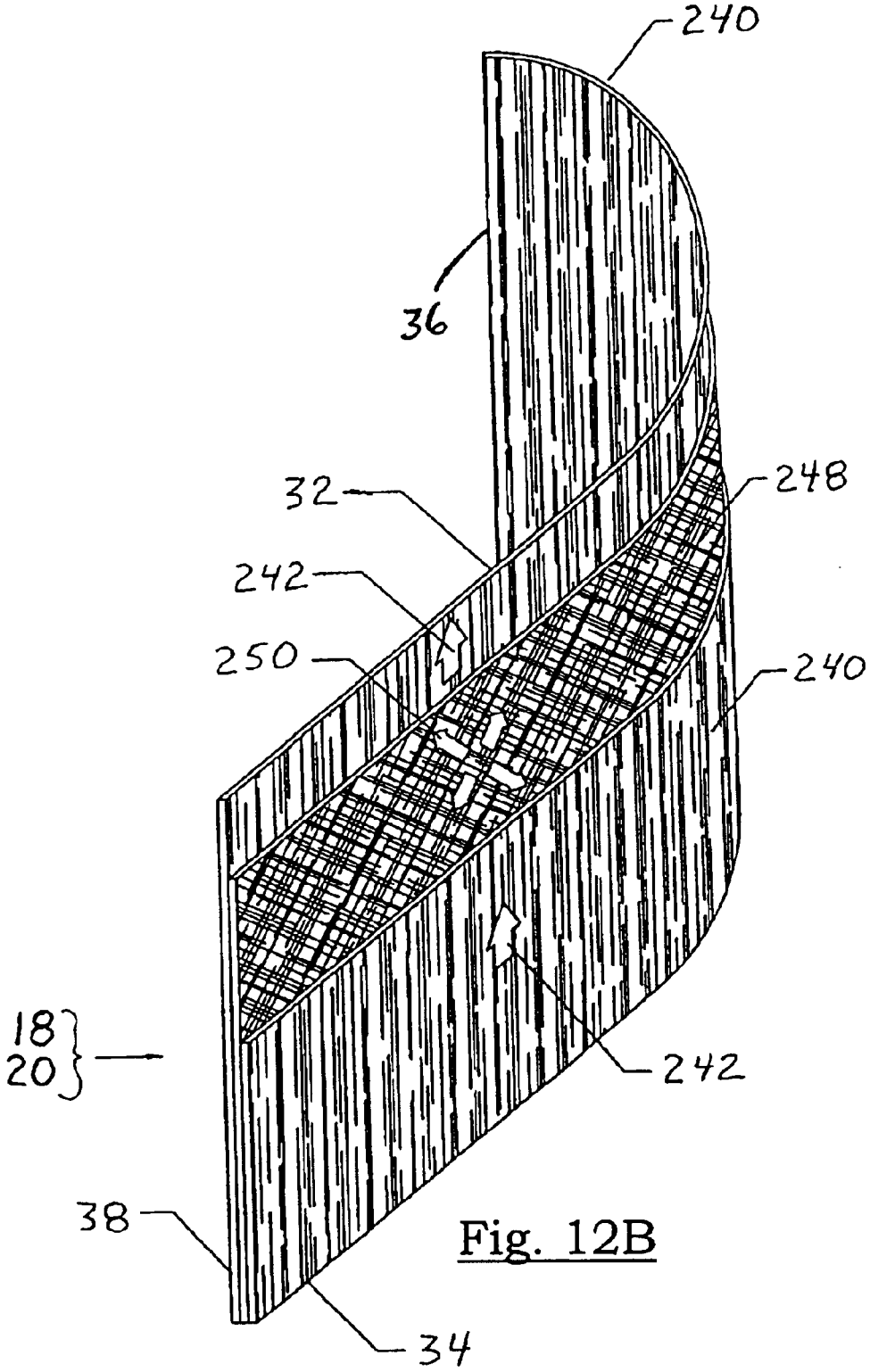
FIG. 12B shows the alignment of the wood strands of the face and core layers of an alternate tensioned wall panel for the present residential house where the wall panel is oriented strand board having a random core.

The sublayers of wood strands which form a panel of oriented strand board are shown in exaggerated form in FIGS. 12A and 12B. FIG. 12A shows oriented strand board with aligned faces and an oriented core. FIG. 12B shows oriented strand board with aligned faces and a random core. In FIGS. 12A and 12B, reference numeral 240 indicates the aligned face layers with reference arrow 242 indicating the longitudinal direction of alignment of the wood strands. In FIG. 12A, reference numeral 244 indicates the oriented core layers with reference arrow 246 indicating the lateral direction of alignment of the wood strands. FIG. 12A shows two aligned core sublayers 244. In FIG. 12B, reference numeral 248 indicates the random core layers with reference arrow 250 indicating the random direction of orientation of the wood strands.

The panels shown in FIGS. 12A and 12B are designated as panel 18 or 20. Either the panel of FIG. 12A (with the oriented core) or the panel of FIG. 12B (with the random core) may be used in home 10.

Figures 13A, 13B, 13C:
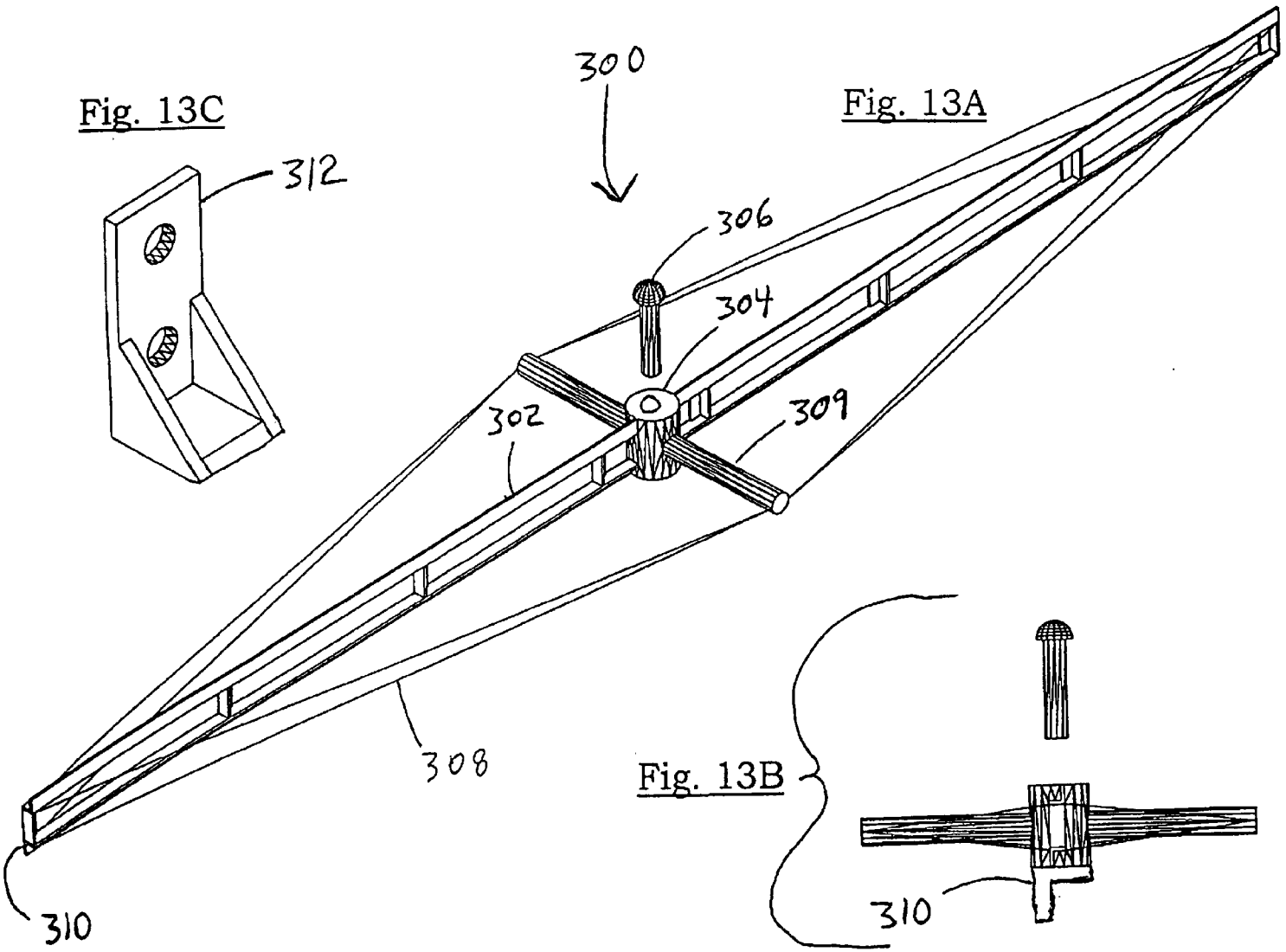
FIG. 13A shows a spinning grader for leveling a subfloor of the present residential home.
FIG. 13B shows an end view of the spinning grader of FIG. 13A.
FIG. 13C shows a scraper for the end of the spinning grader of FIG. 13A.

FIGS. 13A and 13B show a spinning grader 300. Grader 300 includes a beam or beam like member 302 a central tube 304. A pin 306 is inserted through the tube 304 and driven into the ground. The beam 302 includes a plurality of stiffening stays 308 extending from the ends of support arms 309 (fixed to tube 304) to the ends of the beam 302. An angle iron 310 is fixed to the underside of the beam 302 for scraping the ground. A foot digging scraper 312 (shown in FIG. 13C) is fixed to one end or both ends of the beam 302 for a digging a footing for the wall panels 18, 20. The beam 302 may be extendable or may be supplied in the exact length for creating the exact diameter for the home 10. The spinning grader 300 removes high spots and fills in low spots.

Figure 14:
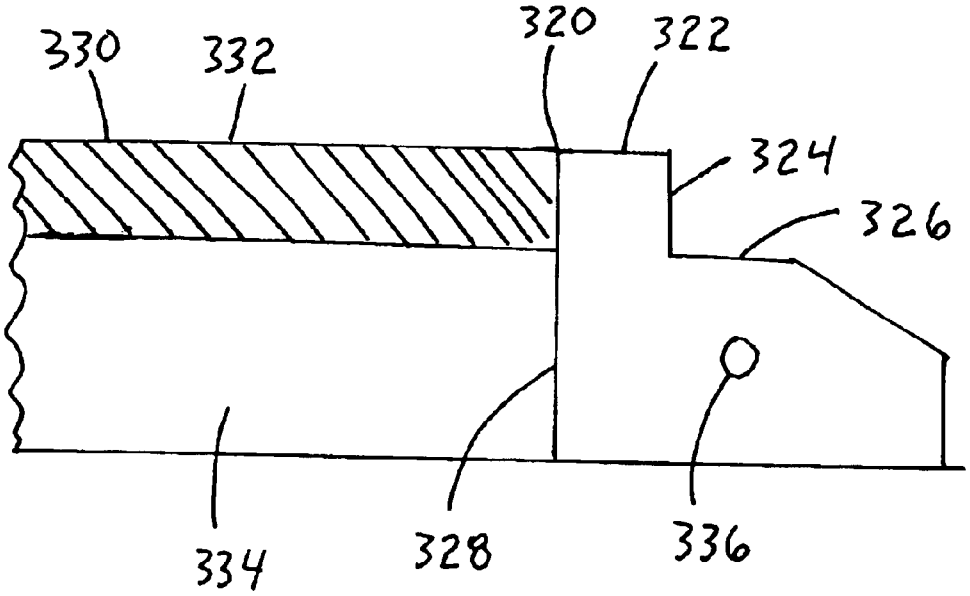
FIG. 14 shows one embodiment of a footing for the wall of the present residential house.

FIG. 14 shows a section view of an annular concrete footing 320 for the home 10. Footing 320 includes an annular flange 322 with an annular inner wall 324 for engaging an inside annular lower portion of wall panels 18 and 20. Footing 320 further includes an annular base 326 on which rests the lower edge 34 of wall panels 18 and 20. Footing 320 further includes an inner upright annular wall 328. Inner upright wall 328 and footing 320 as a whole provides a receptor for a floor 330. Floor 330 includes a floating disc shaped slab 332 of concrete on a subfloor of compact sand 334. Footing 320 further includes rebar 336.

Figure 15A:
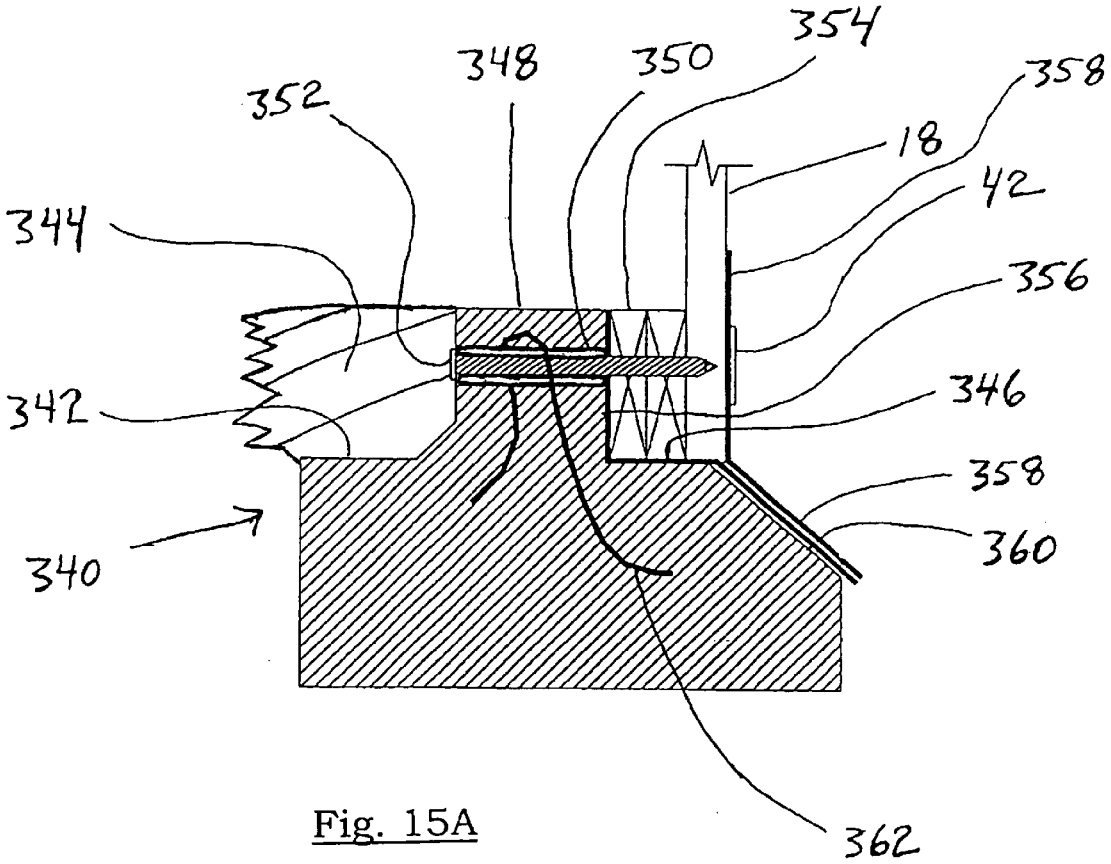
FIG. 15A shows another embodiment of the footing for the wall of the present residential house.

FIG. 15 shows an annular concrete footing 340 similar to footing 320. Footing 340 includes an inner annular base 342 for supporting a disc shaped concrete floor slab 344. Footing 340 further includes an outer annular base 346 for supporting the lower edges 34 of wall panels 18, 20. Footing 340 further includes an annular flange 348 for dividing and spacing the concrete floor slab 344 from the wall panels 18, 20. A plastic tube 350 is cast into the flange 348 for receiving a pin connector 352 which further engages the wall panels 18, 20 to minimize or overcome uplift. Wood blocks 354 may space the annular flange 348 from the wall panels 18, 20. Wood blocks 354 may be replaced by annular studs completely surrounding the flange 348 or by arc like studs. To minimize permeance of water or water vapor, footing 340 includes 1) an inner asphalt barrier 356 disposed between the blocks 354 and flange 348, blocks 354 and outer annular base 346, and lower edges 34 of wall panels 18, 20 and outer annular base 346 and 2) an outer asphalt barrier 358 on an outside lower annular wall portion of wall panels 18, 20, which merges into the inner asphalt barrier 356 on an outer oblique annular face 360. Lower steel strap 42 is wrapped about the outside of outer asphalt barrier 358. Footing 340 further includes reinforcement such as 14 gauge wire 362, a portion of which runs up into flange 348.

Figure 15B:
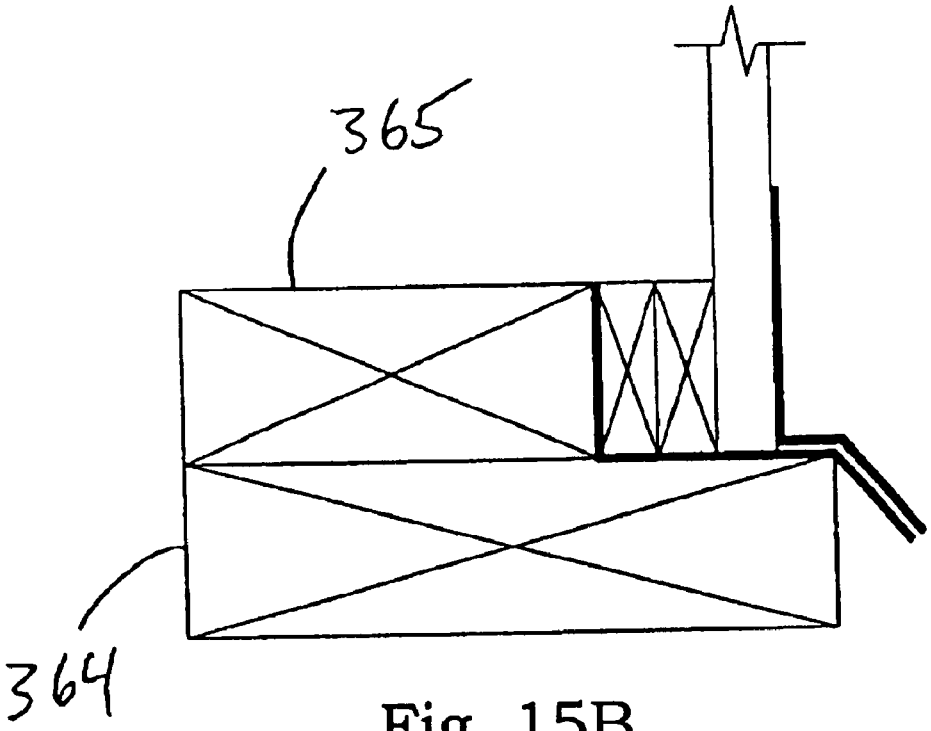
FIG. 15B shows another embodiment of the footing for the wall of the present residential house.

FIG. 15B shows a preserved wood footing 364 where such footing 364 may include chemically and pressure treated wood to prevent decay, rot and attack by termites. Such footing is a permanent footing. Chemical preservatives are forced deep into the cellular structure of the wood. Footing 364 may include a set of planks of 2 inch by 6 inch dimensional lumber cut at an angle at the ends so as to form a ring like base for the wall panels 18, 20. Numeral 365 indicates either a wood or concrete slab floor.

Figure 16:
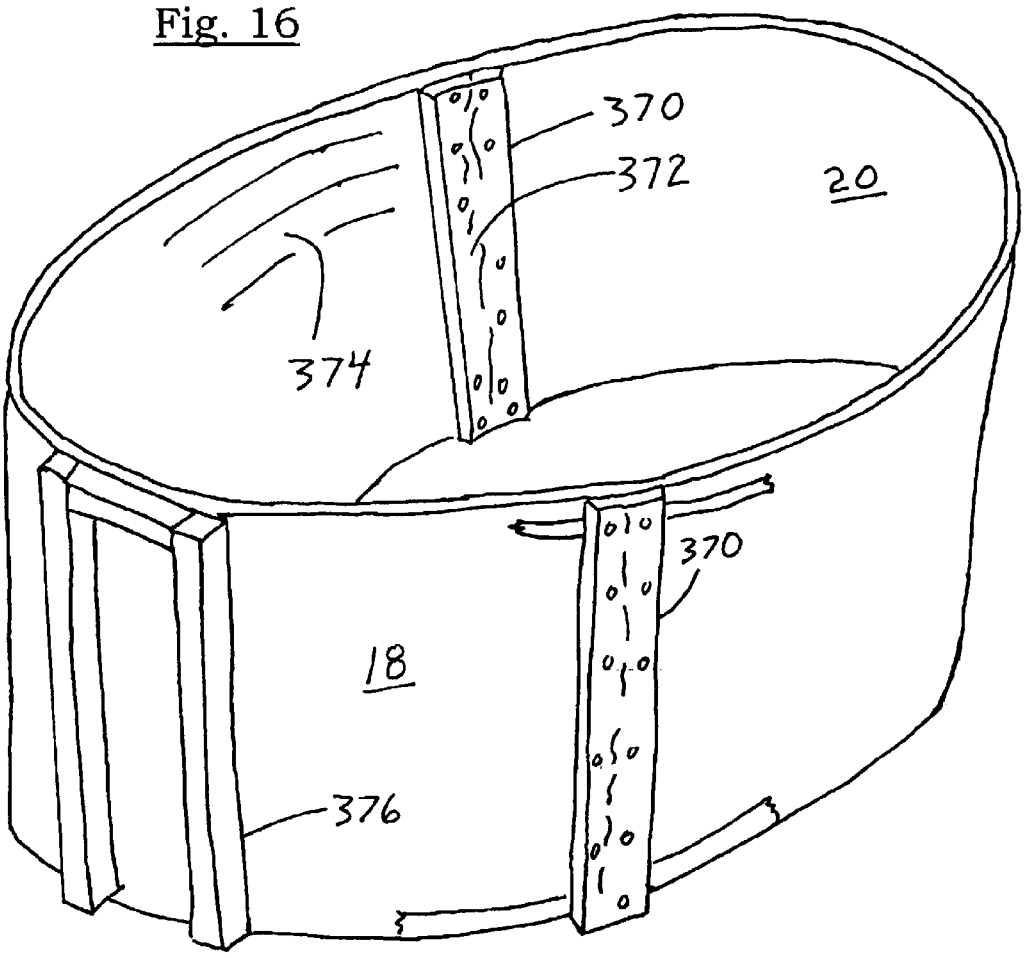
FIG. 16 shows perspective view of the wall panels for the present residential house and indicates how the wall panels are tied in to each other.

FIG. 16 shows that the end edges 36, 38 of wall panel 18 may be engaged to the end edges 36, 38 of wall panel 20 via upright strips 370. An inner strip 370 on an inner face of wall panels 18, 20 is paired with an outer strip 370 and pin connectors 372 extend from inner strip 370, through wall panels 18, 20, and to the outer strip 370. If desired, strip 370 may be one piece and have upright slots or female receptors on either edge, with the one of the slots receiving an end edge 36 or 38 of one of the wall panels 18, 20 and with the other of the slots receiving the end edge 36 or 38 of the other of the wall panels 18, 20. In such an embodiment, the confronting end edges of wall panels are spaced from each other.

FIG. 16 further indicates that each of the wall panels 18, 20 may be replaced by annular sheet strips 374. Each of the strips 374 is held in its tensioned position with one steel strap (such as steel strap 40 or 42). Where vehicle transport to outlying areas is not possible, sheet strips 374 may be used. Strips 374 may be hand carried. Strips 374 (or the one piece wall panels 18, 20) may be pulled to a circular form or a generally circular form with the steel straps.

FIG. 16 further shows an opening frame 376 such as for a door or window. Frame 376 is first engaged to wall panel 18 or 20 with pin connectors and at a subsequent time the door or window opening is cut. The cut out material is used to make the door or a shutter for window.

It should be noted that sheet strips 374 or the one piece wall panels 18, 20 may be formed of oriented strand board, plywood, cement boards, fiberglass, composites such as organic composites, steel, and aluminum.

It should be noted that sheet strips 374 or the one piece wall panels 18, 20 may be relatively thin or relatively thick. A thicker sheet strip 374 or a thicker one piece wall panel 18, 20 creates extra tension. A thicker sheet strip 374 or a thicker one piece wall panel 18, 20 is preferred where wind load requirements are greater and where the home 10 has a larger diameter.

Figures 17A, 17D:
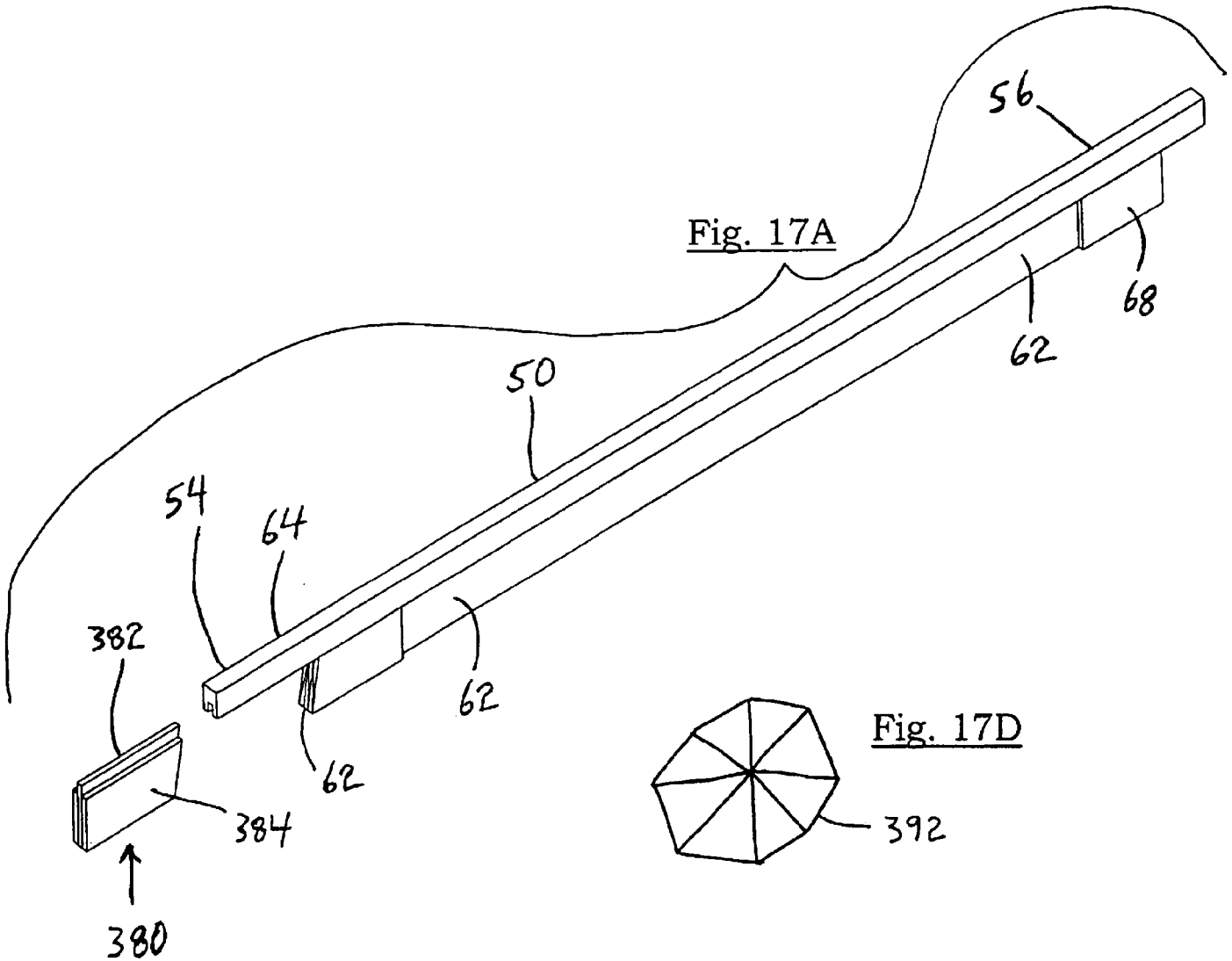
FIG. 17A shows a perspective view of the radial beam of the rafter support network.
FIG. 17D shows a top view of a disc shaped ring cover.
Figures 17B, 17C:
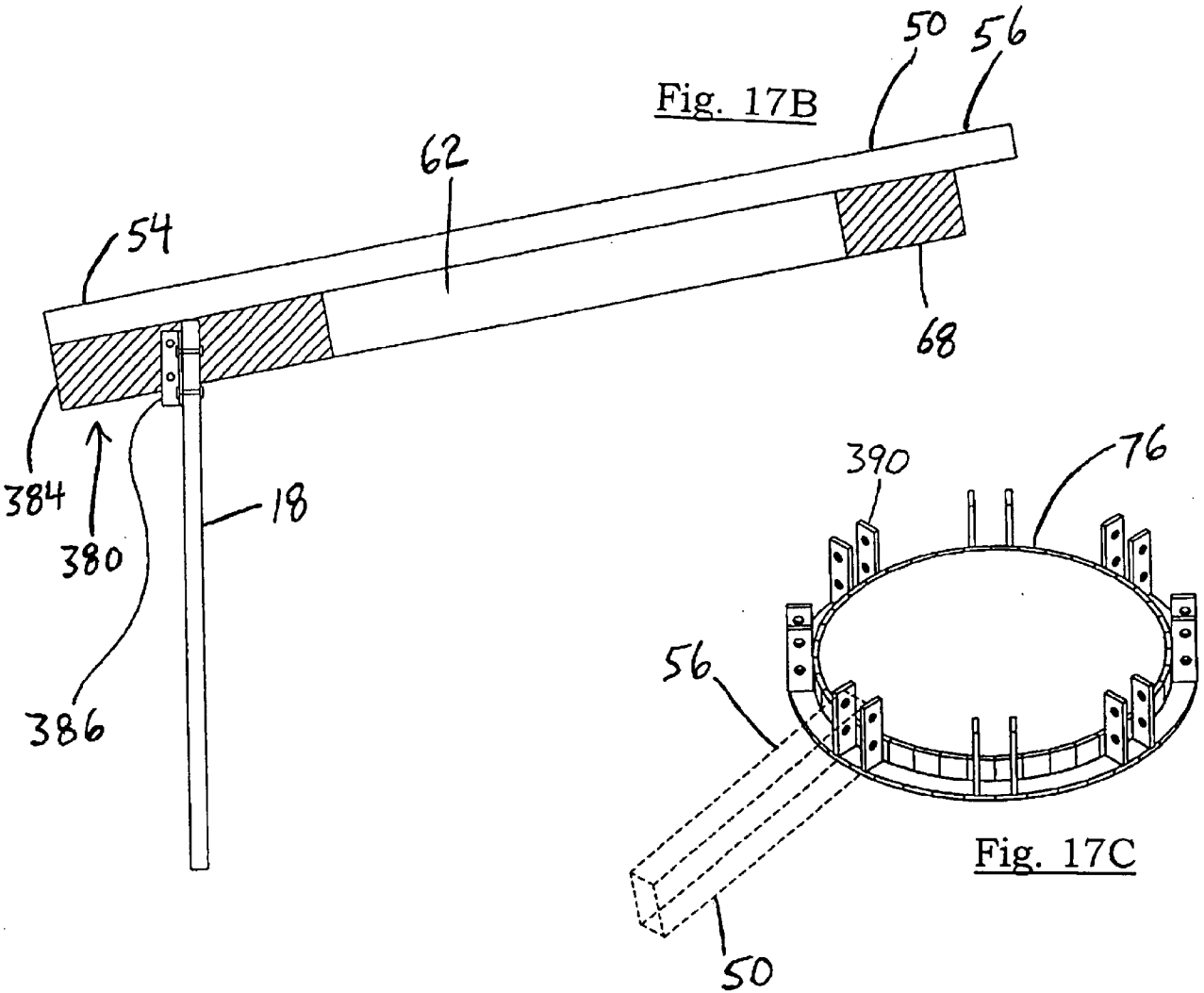
FIG. 17B shows a side view of the radial beam of FIG. 17A.
FIG. 17C shows a perspective view of the central ring for the rafter support network.

FIGS. 17A and 17B show that the radial beam 50 may include a separate tail section 380. Tail section 380 includes a central web 382 and a pair of web stiffeners 384. Web 382 engages the mortised slot in flange 64 and web stiffeners 382 abut the flange 64. Web 62 may terminate short of outer end 54 of flange 64 and abut the inner face of wall panels 18, 20. Tail section 380 abuts the outer face of wall panels 18, 20 with the inner edges of web 382 and web stiffeners 382. An angle iron 386 engaged to the outer face of wall panel 18 or 20 and further engaged to tail section 380 prevents or minimizes the chance of uplift that otherwise may separate the roof 14 from the endless wall 12.

FIG. 17C shows how the nose portions or inner ends 56 of the radial beams 50 fit into the angle iron metal central ring 76. The rafter noses or inner ends 56 of the radial beams are bolted through sides to vertical fins or brackets 390 which are welded or bolted to the angle iron ring 76. Nose web stiffeners 68 and web 62 may terminate short of inner end 56 of radial beam 50, as shown in FIG. 17B.

FIG. 17D shows ring cover 392 for fitting over the opening 77. Ring cover 392 preferably lies above the roof panels 84 or shingles fixed on the inner roof panels or sheathing 84 to permit air flow from the interior of the home 10 to the outside while preventing rain or snow from falling through opening 77. Ring cover 392 may be plastic or metal. Ring cover 392 may be mounted via brackets 390.

FIG. 18A shows a top view of the metal ring 76 and shows holes 400 for receiving bolts engaging the fins or brackets 390. Alternate brackets include C-shaped brackets 402 (shown in FIG. 18C) or U-shaped brackets 404 (shown in FIG. 18E) for generally surrounding the nose of the radial beam 50. A rafter or beam 50 may bolted between two bent brackets or straps 402 or between two inverted U-shaped brackets 404 and the ring cover 392 is bolted to the upper ends of the straps 390 or 402 or 404. Alternatively, a rafter nose 56 may be bolted within the U-shape or C-shape features of such brackets.

FIG. 18D shows how the nose or inner end 56 of rafter 50 may be birdsmouthed (for reception of ring 76) and thickened for bolt holes and further shows how the upper ends of brackets 390, 402 or 404 may be spaced from the flange 64 to provide an air gap. Ring cover 392 may be engaged to the upper ends of such brackets 390, 402, or 404 to permit air flow between the inside of outside of the house 10 while shielding the inside of the house 10 from rain and snow.

FIG. 18B shows an alternate to perforated metal ring 76, specifically a perforated center piece 408. Center piece 408 is formed in two sections 410 so that a square or rectangular or straight center section 412 may be engaged between the semicircular sections 410.

Figures 19A, 19B:
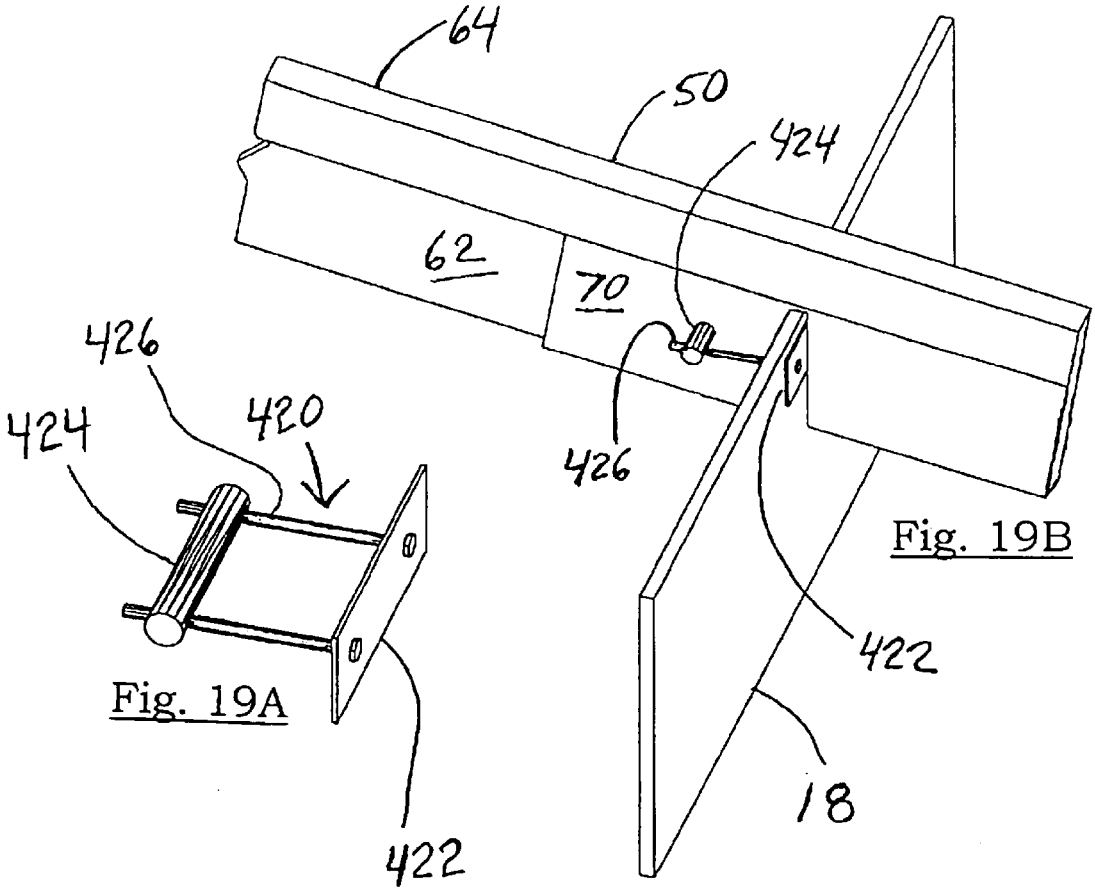
FIG. 19A shows a perspective view of a tie for being engaged between the outer end or nose of the radial beam of FIG. 17A and the wall of the present residential house.
FIG. 19B shows a side view of the tie of FIG. 19A engaged between the outer end or nose of the radial beam of FIG. 17A and the wall of the present residential house.
Figure 19D:
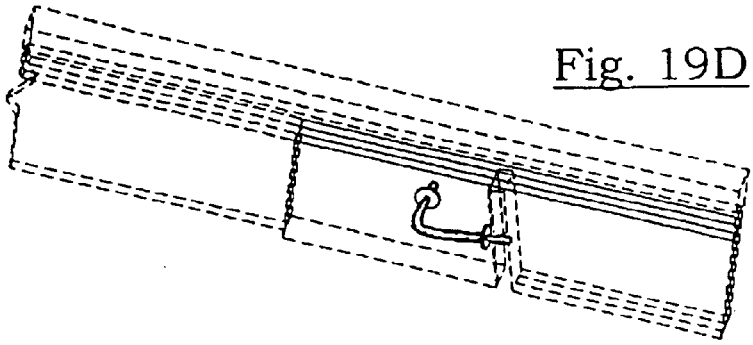
FIG. 19D shows a perspective view of the tie of FIG. 19C engaged.

FIG. 19A shows a tie 420 that may be used between the tail 54 or outer end of rafter 50. Tie 420 includes a flat plate 422, a piece of round stock 424 drilled and tapped to receive bolts 426 extending between and tying together the plate 422 and stock 424. As shown in FIG. 19B and FIG. 19E, flat plate 422 is pressed onto wall panels 18, 20, bolts 426 extend through wall panels 18, 20, and round stock 424 engages web stiffeners 70 and web 62 to tie the roof 14 to the wall 12 so as to minimize uplift of roof 14.

Figure 19C:
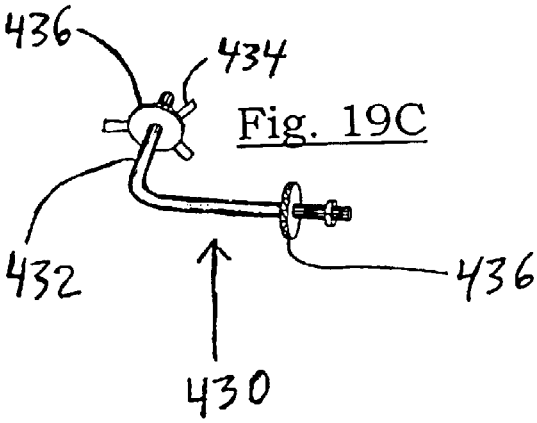
FIG. 19C shows a perspective view of an alternate embodiment of the tie of FIG. 19A.
Figure 19E:
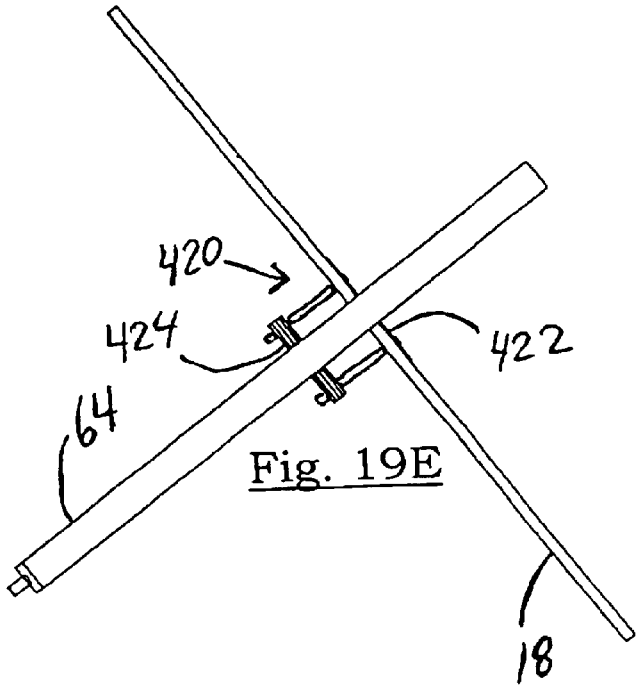
FIG. 19E shows a top view of the tie of FIG. 19A.

FIG. 19C shows an alternate tie 430 where the tie 430 is L-shaped and includes an end 432 passing horizontally through beam 50, specifically web stiffener 70 and web 62. End 432 includes a split pin 434 holding a flat plate 436 pressed onto a face of web stiffener 70. The other end of tie 430 also includes a flat plate 436 for pressing into wall 18 or 20.

Figure 20:
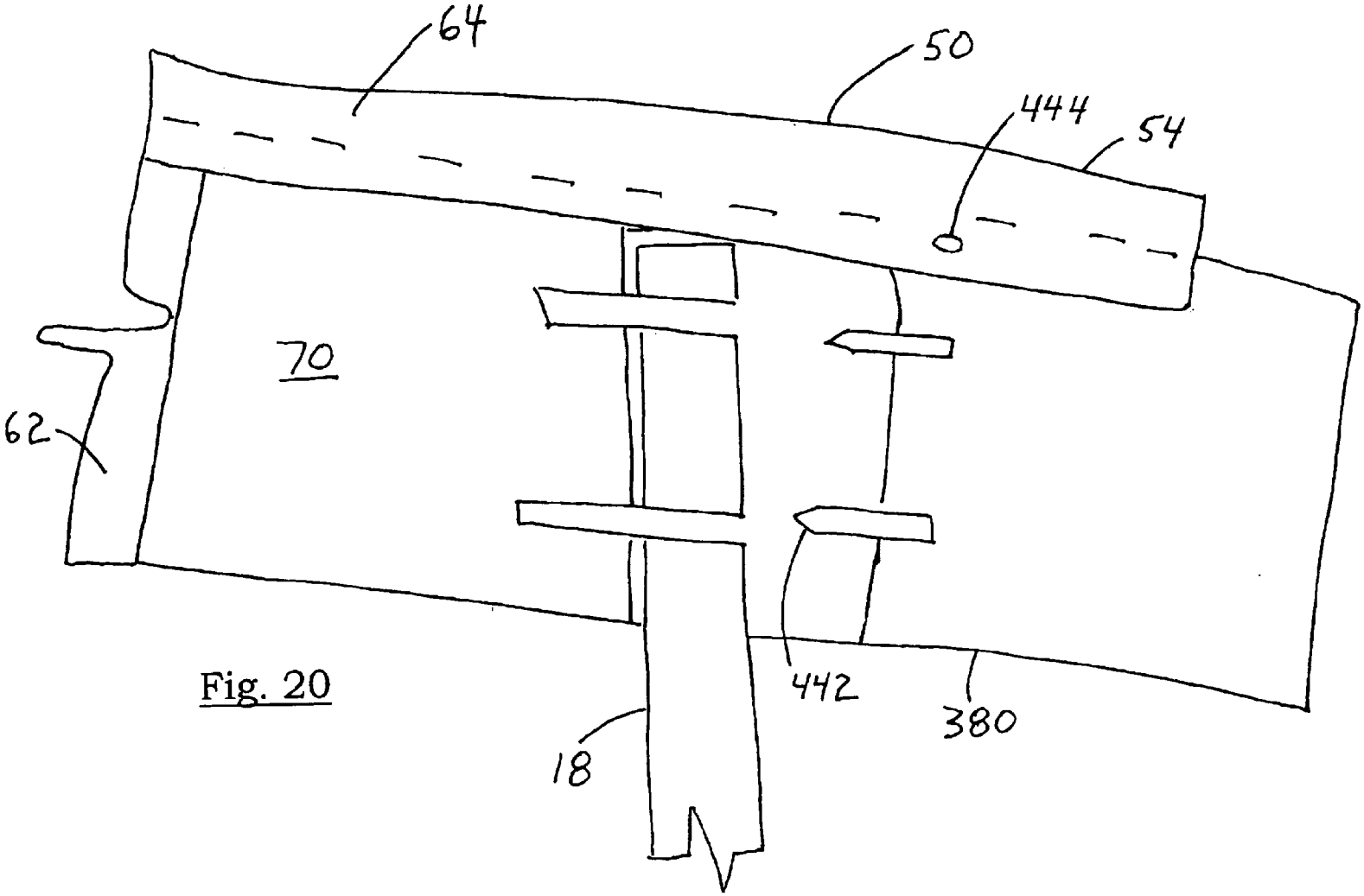
FIG. 20 shows another embodiment of a tail section for the radial rafter or beam.

FIG. 20 shows still another tie 440. Tie 440 includes a tail section 380 having one or more pin connectors 442 fixed to one or more of the web 382 or web stiffeners 384, running through wall panel 18 or 20 and into one or more of web 62 and web stiffeners 70. Roof 14 is thereby locked into wall 12. One method for installing tie 440 includes initially sliding the tail section 380 up to wall panel 18 or 20 such that the pin connectors 442 directly mark the wall panel 18 or 20 as to the locations where holes for the pin connectors 442 are to be drilled. Such holes are then drilled through wall panels 18, 20 and into one or more of web 62 and web stiffeners 70. The tail section 380 may be tied to flange 64 with pin connectors such as through holes 444 so as to further minimize the chance of uplift.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalents of the claims are intended to be embraced therein.

What is claimed is:

1. A residential house having a floor and a roof, comprising, in combination:

a) at least one wall panel, with the wall panel:

i) having upper and lower edges, wherein the lower edges are at the floor of the residential house and wherein the upper edges are at the roof of the residential house, and wherein the wall panel has sufficient rigidity between the upper and lower edges to support a roof load and to further support a live roof load;

ii) having a pair of end edges running between the upper and lower edges, with a distance between the end edges along the wall panel being greater than 19½ feet when the wall panel is in a nontensioned form and such that a length of said wall panel is greater than a height of the wall panel;

iii) being one-piece;

iv) being in a generally curved form and having a concave face and a convex face, with the concave face being oriented toward an interior of the residential house;

v) having an outward tension, with the outward tension being from the concave face to the convex face; and vi) comprising a sheet of oriented strand board, wherein the oriented strand board is a wood product, wherein the oriented strand board is not particle board, wherein the oriented strand board is not flakeboard, wherein the oriented strand board comprises wood strands sliced from wood in a direction of a grain of the wood such that inherent tree strength is maintained in the oriented strand board, wherein the sheet of oriented strand board comprises a first face layer of wood strands, a second face layer of wood strands, and a core layer of wood strands between the first and second face layers, wherein the wood strands of the face layers are aligned in one direction, and wherein said one direction is a vertical direction running between the floor and the roof;

b) a counter engaged to the wall panel to oppose the outward tension to fix the wall panel in the generally curved form;

c) wherein the roof is on the wall panel so as to form the residential house; and d) wherein the residential house is studless.

2. The residential house according to claim 1 wherein the residential house comprises first and second wall panels, with the concave faces of each of the wall panels being oriented to face each other and being fixed in such an orientation.

3. The residential house according to claim 1 wherein the roof comprises a support network and wherein the counter comprises at least a portion of the support network.

4. The residential house according to claim 1 and further comprising a floor level support for the residential house, wherein the counter comprises at least a portion of the floor level support.

5. The residential house according to claim 1 wherein the counter comprises a fastener engaged to an end edge of the wall panel.

6. The residential house according to claim 2 where the counter comprises the first and second wall panels themselves, with respective end edges of the first and second wall panels being engaged to each other.

7. The residential house according to claim 1 wherein the counter comprises a strap.

8. The residential house according to claim 2 wherein the counter comprises a pair of straps surrounding the first and second wall panels, with one of the straps being disposed at a generally upper section of the first and second wall panels and with the other of the straps being disposed at a generally lower section of the first and second wall panels.

9. The residential house according to claim 2 wherein the end edges of the first wall panel confront the end edges of the second wall panel such that the first and second wall panels form generally the shape of a circle.

10. The residential house according to claim 2 wherein the end edges of the first wall panel are spaced from the end edges of the second wall panel, and further comprising wall sections between respective end edges of the first and second wall panels.

11. The residential house according to claim 2 wherein one end edge of the first wall panel confronts one end edge of the second wall panel and wherein the other edge of the first wall panel is spaced from the other edge of the second wall panel, and further comprising a door engaged between said other edges which are spaced from each other.

12. The residential house according to claim 1 and further comprising a door opening in the wall panel.

13. The residential house according to claim 1 and further comprising a window opening in the wall panel.

14. A residential house having a floor and a roof, comprising, in combination:

a) at least one wall panel, with the wall panel:

i) having upper and lower edges, wherein the lower edges are at the floor of the residential house and wherein the upper edges are at the roof of the residential house, and wherein the wall panel has sufficient rigidity between the upper and lower edges to support a roof load and to further support a live roof load;

ii) having a pair of end edges running between the upper and lower edges, with a distance between the end edges along the wall panel being greater than 19½ feet when the wall panel is in a nontensioned form and such that a length of said wall panel is greater than a height of the wall panel;

iii) being one-piece;

iv) being in a generally curved form and having a concave face and a convex face, with the concave face being oriented toward an interior of the residential house;

v) being tensioned outwardly;

vi) being fixed in the generally curved form;

vii) comprising a sheet of oriented strand board, wherein the oriented strand board is a wood product, wherein the oriented strand board is not particle board, wherein the oriented strand board is not flakeboard, wherein the oriented strand board comprises wood strands sliced from wood in a direction of a grain of the wood such that inherent tree strength is maintained in the oriented strand board, wherein the sheet of oriented strand board comprises a first face layer of wood strands, a second face layer of wood strands, and a core layer of wood strands between the first and second face layers, wherein the wood strands of the face layers are aligned in one direction, and wherein said one direction is a vertical direction running between the floor and the roof;

b) wherein the roof is on the wall panel so as to form the residential house; and c) wherein the residential house is studless.

15. A method for building a residential house having a floor, a wall and a roof, comprising, in combination, the steps of:

a) choosing first and second sheets of tensionable material for said wall of the residential house, with each of the sheets of tensionable material having ends, with each of the sheets of tensionable material being flexible between a generally flat form having potential tension and a generally curved form having a tension biased toward the generally flat form, wherein each of the first and second sheets runs from the floor of the residential house to the roof of the residential house, wherein said sheets have sufficient rigidity on edge to support a roof load and to further support a live roof load, wherein each of said sheets includes a length of more than 19½ feet when said sheet is in a nontensioned form and such that a length of said wall panel is greater than a height of the wall panel, and wherein the step of choosing comprises the step of selecting sheets of oriented strand board as the first and second sheets of tensionable material, wherein the oriented strand board is a wood product, wherein the oriented strand board is not particle board, wherein the oriented strand board is not flakeboard, wherein the oriented strand board comprises wood strands sliced from wood in a direction of a grain of the wood such that inherent tree strength is maintained in the oriented strand board, wherein the sheet of oriented strand board comprises a first face layer of wood strands, a second face layer of wood strands, and a core layer of wood strands between the first and second face layers, wherein the wood strands of the face layers are aligned in one direction, and wherein said one direction is a vertical direction running between the floor and the roof;

b) bending each of the sheets into the generally curved form so as to form a generally concave face and so as to produce tension in the generally curved form;

c) countering the tension in the sheets when the sheets are in the generally curved form, fixing the sheets in the generally curved form, and orienting the sheets relative to each other such that the concave faces are oriented toward each other and such that the each of the ends of one sheet confronts one end of the other sheet to make an enclosure; and d) placing the roof on the sheets to form the residential house.

16. A method for bending without breaking a panel of oriented strand board, with the panel having two end edges, with the method comprising, in combination, the steps of:

a) selecting a panel of oriented strand board, wherein the oriented strand board is a wood product, wherein the oriented strand board is not particle board, wherein the oriented strand board is not flakeboard, wherein the oriented strand board comprises wood strands sliced from wood in a direction of a grain of the wood such that inherent tree strength is maintained in the oriented strand board, wherein the panel of oriented strand board comprises a first face layer of wood strands, a second face layer of wood strands, and a core layer of wood strands between the first and second face layers, and wherein the wood strands of the face layers are aligned in one direction, wherein the panel of oriented strand board comprises end edges, wherein the end edges run in said one direction; then b) drawing the end edges toward each other to form a curved panel of oriented strand board; and then c) fixing the curved panel of oriented strand board in place.

17. The method of claim 16 wherein the panel includes a medial portion, wherein the step of initiating a bend in the panel comprises the step of initiating a bend in the panel at a location in the medial portion, and wherein the step of continuing to bend the panel incrementally comprises the step of continuing to bend the panel in each of two direction, with one of the directions being from the location to one of the end edges and with the other of the directions being from the location to the other of the end edges.

18. A residential house having a roof and comprising:

a) a sheet, wherein the sheet includes a height sufficient to serve as a wall of the residential house;

b) wherein the sheet includes a length, with the length being defined by the upper and lower edges, wherein the sheet has sufficient rigidity between the upper and lower edges to support a roof load and to further support a live roof load;

c) wherein the sheet is one-piece;

d) wherein the sheet is in a generally curved form;

e) wherein the sheet is tensioned so as to be biased toward a flat form;

f) wherein the sheet is fixed in the generally curved form;

g) wherein the sheet is a sheet of oriented strand board, wherein the oriented strand board is a wood product, wherein the oriented strand board is not particle board, wherein the oriented strand board is not flakeboard, wherein the oriented strand board comprises wood strands sliced from wood in a direction of a grain of the wood such that inherent tree strength is maintained in the oriented strand board, wherein the sheet of oriented strand board comprises a first face layer of wood strands, a second face layer of wood strands, and a core layer of wood strands between the first and second face layers, wherein the wood strands of the face layers are aligned in one direction, wherein the sheet of oriented strand board comprises end edges, wherein the end edges run in said one direction, wherein the end edges of the sheet have been drawn towards each other to form the generally curved form; and h) wherein the roof is on the sheet so as to form the residential house.

19. The residential house of claim 18, wherein the length runs a distance greater than the height of the sheet.

20. The residential house of claim 18, wherein the sheet includes a length, wherein the length is greater than 19½ feet when the sheet is in the flat form.

* * * * *